US006550888B2

(12) United States Patent
Iwata et al.

(10) Patent No.: US 6,550,888 B2
(45) Date of Patent: Apr. 22, 2003

(54) RECOVERY OF INK JET RECORDING APPARATUS USING CONTROLLED SUCTION OF INK

(75) Inventors: Kazuya Iwata, Kawasaki (JP); Jun Katayanagi, Musashino (JP); Hiroyuki Saito, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/037,955

(22) Filed: Oct. 19, 2001

(65) Prior Publication Data

US 2002/0060710 A1 May 23, 2002

Related U.S. Application Data

(60) Continuation of application No. 08/954,064, filed on Oct. 20, 1997, which is a continuation of application No. 08/068,216, filed on May 28, 1993, now abandoned, which is a division of application No. 07/653,702, filed on Feb. 11, 1991, now Pat. No. 5,245,362.

(30) Foreign Application Priority Data

Feb. 13, 1990 (JP) ..... 2-029410
Feb. 13, 1990 (JP) ..... 2-029411
Feb. 13, 1990 (JP) ..... 2-029412

(51) Int. Cl.[7] ..... B41J 2/165
(52) U.S. Cl. ..... 347/23; 347/30
(58) Field of Search ..... 347/22, 23, 29, 347/30, 35

(56) References Cited

U.S. PATENT DOCUMENTS

| | | | |
|---|---|---|---|
| 4,313,124 A | 1/1982 | Hara | 347/57 |
| 4,313,684 A | 2/1982 | Tazaki | 347/77 |
| 4,345,262 A | 8/1982 | Shirato et al. | 347/10 |
| 4,394,669 A | 7/1983 | Ozawa | 347/30 X |

(List continued on next page.)

FOREIGN PATENT DOCUMENTS

| | | |
|---|---|---|
| DE | 3633239 | 9/1986 |
| FR | 2460787 | 1/1981 |
| JP | 58-063453 | 4/1983 |
| JP | 58-096561 | 6/1983 |
| JP | 58-107355 | 6/1983 |
| JP | 60-145854 | 8/1985 |
| JP | 61-012350 | 1/1986 |
| JP | 61-078654 | 4/1986 |
| JP | 61-215059 | 9/1986 |
| JP | 62-199449 | 9/1987 |
| JP | 2-29345 | 1/1990 |

OTHER PUBLICATIONS

H.K. Seitz, Nozzle Cleaning Process, IBM Technical Disclosure Bulletin, vol. 20, No. 2, Jul. 1977, pp. 786–788.

L. Pietraszkiewicz and S. Elias, Internal Cleaning Unit Resolves Traditional Ink–Jet Limitations, 8211 Computer Technology Review, 4 (1984), No. 4, pp. 137–139.

*Primary Examiner*—Craig Hallacher
(74) *Attorney, Agent, or Firm*—Fitzpatrick, Cella, Harper & Scinto

(57) ABSTRACT

In an ink jet recording apparatus having an ink jet head, an ink discharge from the head is executed to maintain and recover the discharge performance thereof. A cap is located opposite to the ink jet head when the maintaining and recovering ink discharge is performed, and receives the discharged ink. A waste ink tank receives ink exhausted from the cap. An ink pump transports ink received by the cap to the waste ink tank by performing idle suction. The number of times the idle suction is performed is variable, and is controlled by a control unit. The idle suction includes idle suction for recovery suction and idle suction for idle discharge. The idle suction for recovery suction is characterized as suction of ink when the cap caps the ink jet head, and the idle suction for idle discharge is characterized as suction of ink when the cap is communicated with atmosphere. The number of times of the idle suction is less for the idle suction for idle discharge than for the idle suction for recovery suction.

84 Claims, 22 Drawing Sheets

U.S. PATENT DOCUMENTS

| | | | | |
|---|---|---|---|---|
| 4,459,600 | A | 7/1984 | Sato et al. | 347/47 |
| 4,463,359 | A | 7/1984 | Ayata et al. | 347/56 |
| 4,464,668 | A | 8/1984 | Komai et al. | 347/89 |
| 4,524,365 | A | 6/1985 | Kakeno et al. | 347/36 X |
| 4,558,333 | A | 12/1985 | Sugitani et al. | 347/65 |
| 4,571,599 | A | 2/1986 | Rezanka | 347/87 |
| 4,587,535 | A | 5/1986 | Watanabe | 347/23 |
| 4,631,554 | A | 12/1986 | Terasawa | 347/30 |
| 4,631,556 | A | 12/1986 | Watanabe et al. | 347/30 |
| 4,692,777 | A | 9/1987 | Hasumi | 347/23 |
| 4,748,459 | A | 5/1988 | Ichihashi | 347/31 |
| 4,819,012 | A | 4/1989 | Kiyohara | 347/36 X |
| 4,847,637 | A | 7/1989 | Watanabe et al. | 347/30 |
| 4,926,196 | A | 5/1990 | Mizoguchi | 347/23 |
| 4,965,596 | A | 10/1990 | Nagoshi | 347/36 |
| 4,967,204 | A | 10/1990 | Terasawa et al. | 347/23 |
| 5,164,748 | A | 11/1992 | Katayanagi et al. | 347/30 |
| 5,170,186 | A | 12/1992 | Shimomura et al. | 347/23 |
| 5,172,130 | A | 12/1992 | Takahashi | 347/13 |
| 5,245,362 | A | 9/1993 | Iwata | 347/23 |

① LOWER DEAD CENTER

③ STOP POSITION AFTER PUMPING

② UPPER DEAD CENTER

④ POSITION FOR PREPARING IDLE SUCTION

⑤ STOP POSITION AFTER MEDIUM IDLE SUCTION

RECOVERY OF INK JET RECORDING APPARATUS USING CONTROLLED SUCTION OF INK

This application is a continuation of application Ser. No. 08/954,064, filed Oct. 20, 1997, which is hereby incorporated herein by reference, and which was a continuation of application Ser. No. 08/068,216, filed May 28, 1993, now abandoned, which was a division of application Ser. No. 07/653,702, filed Feb. 11, 1991, now U.S. Pat. No. 5,245,362, issued Sep. 14, 1993.

BACKGROUND OF THE INVENTION

1. Field of the Invention

This invention relates to an ink jet recording apparatus and a discharge recovery apparatus used in said apparatus.

2. Related Background Art

For a recording apparatus, which conventionally records on a recording medium (hereinafter called "recording sheet" or simply "paper") such as paper and sheet for OHP, forms of mounting a recording head using any of various recording methods have been proposed. This recording head has various methods such as wire dot, thermal, thermal transfer, and ink jet methods.

Especially the ink jet method directly jets ink on a recording sheet, and draws attention as a quiet recording method with low running cost.

In a recording apparatus using the ink jet method, a recording head, in which fine discharge ports have been arranged, is generally used. When air bubble or dust enters the discharge port, or when ink has become unsuitable for discharge or recording owing to thickening caused by evaporation, of ink solvent, etc., and the like, the state of discharge is maintained or recovered by the following: refreshing the ink by recovering the suction through the discharge port or by predischarging, or allowing some discharge ports, which are not concerned in discharge during recording, to discharge ink in order to maintain all discharge ports in a condition suitable for discharging always.

As a form of the means to maintain and recover the discharge, there is a recording apparatus provided with a cap member capable of covering the discharge port formation surface of the recording head, and with suction means such as pump means which communicates with this cap member and applies a suction force to the discharge port of the recording head.

The factor for improper discharge is removed together with the ink by discharging ink (predischarge, idle discharge) by driving an ink discharge energy generating element inside the discharge port while the cap is opposed to the discharge port formation surface, or by forcibly discharging ink by sucking ink through the discharge port by applying the suction force while the discharge port formation surface is covered with the cap.

In an appropriate position of the apparatus, on the other hand, there is a waste ink tank provided to store waste ink produced by the above-mentioned discharge recovery process.

To lead, into the waste ink tank, the ink received in a discharge recovery apparatus including the cap, pump and waste ink tube communicating these, etc. by the discharge recovery process, a so-called "idle suction" operation, in which the pump is operated while the cap is opened to air, is performed.

This is a very effective operation to prevent remaining waste ink from hardening, and prevent waste ink from leaking outward from the cap when the ink, received within the discharge recovery device by the discharge recovery process, is left to stand alone.

In these processes, however, an amount of ink to be discharged by predischarge, for example, an amount of ink to be discharged by idle discharge or an amount of ink to be exhausted by suction are respectively different because their objectives are respectively different. Nevertheless, an operation of pump means to recover exhausted ink was similar in any of these processes.

In this case, in idle discharge, for example, which is performed by also allowing discharge ports, which are not used, midway during recording to be used for discharging, a duration, in which the recording head remains at a non-recording position, is long. To cope with high speed recording by improving the throughput, it takes a considerable time to maintain and recover, and high speed recording as a whole cannot be accomplished.

Also when a piston type pump was used, ink trapped by an absorber provided within the cap was recovered by repeating the full stroke several times. In this method, however, there were some cases where ink remains in an area far away from the recovery port though ink near the recovery port is well recovered.

In other words, although ink near the recovery port is quickly recovered by driving the piston, ink in an area far away from the recovery port takes time to move to near the recovery port, and cannot fully move only by the suction operation—driving the piston was terminated before the ink moves. As a result, the ink remained in the absorber. Such an existence of such residual ink was likely to cause fixing within the absorber.

Also the number of times for discharge recovery process to be started differs in accordance with frequency in use and product life that vary with the application and the like of the ink jet recording apparatus. In other words, in a recording apparatus with a use application, in which a large amount of waste ink is required, a large capacity of waste ink tank will be required. This is because the volume, which the waste ink tank occupies within the apparatus, becomes larger.

On the other hand, however, miniaturized recording apparatus has been advancing in recent years, and therefore an appropriate ingenuity should be exerted in securing the capacity of the waste ink tank.

SUMMARY OF THE INVENTION

Thus, it is an object of the present invention to securely lead waste ink within a discharge recovery apparatus into a waste ink tank by efficiently and securely performing idle suction.

It is also an object of the present invention to perform idle suction which does not deteriorate the throughput during recording.

It is a further object of the present invention to provide an apparatus capable of fully recovering waste ink within a small capacity of waste ink tank by effectively utilizing the space within the apparatus.

It is an object of the present invention to provide a discharge maintaining and recovery apparatus, comprising:

ink receiving means capable of receiving ink which is located opposite to a recording head and comes into contact with said recording head when maintaining and recovering discharge in order to maintain and recover a state of ink discharge from said recording head for discharging ink on a recording medium;

transporting means which connects said ink receiving means to an exhaust ink receiving member for receiving ink exhausted by the discharge maintaining and recovery process, and transports received ink in said ink receiving means into said exhaust ink receiving member; and control means which performs a first discharge maintaining and recovery process for exhausting ink by means of discharge not concerned in recording by driving said recording head, and a second discharge maintaining and recovery process for exhausting ink by allowing said ink receiving means to come into contact with said recording head and by driving said transporting means, wherein;

said transporting means has more drive in the second discharge maintaining and recovery process than in the first discharge maintaining and recovery process.

It is also an object of the present invention to provide an ink jet recording apparatus, comprising:

a supporting member for supporting said recording head which discharges ink on a recording medium;

ink receiving means capable of receiving ink which is located opposite to a recording head and comes into contact with said recording head when maintaining and recovering discharge in order to maintain and recover a state of ink discharge from said recording head for discharging ink on said recording medium;

transporting means which connects said ink receiving means to an exhaust ink receiving member for receiving ink exhausted by the discharge maintaining and recovery process, and transports received ink in said ink receiving means into said exhaust ink receiving member;

control means which performs a first discharge maintaining and recovery process for exhausting ink by means of discharge not concerned in recording by driving said recording head, and a second discharge maintaining and recovery process for exhausting ink by allowing said ink receiving means to come into contact with said recording head and by driving said transporting means, wherein;

said transporting means has more drive in the second discharge maintaining and recovery process than in the first discharge maintaining and recovery process; and transporting means for transporting said recording medium.

It is also an object of the present invention to provide a discharge maintaining and recovery apparatus, comprising:

ink receiving means capable of receiving ink which is located opposite to a recording head when maintaining and recovering discharge in order to maintain and recover a state of ink discharge from said recording head for discharging ink on a recording medium; and pump type transporting means consisting of a piston and cylinder which connects said ink receiving means to an exhaust ink receiving member for receiving ink exhausted by the discharge maintaining and recovery process, and transports received ink in said ink receiving means into said exhaust ink receiving member, wherein;

in said pump type transporting means, the first stroke is different from the last stroke in piston reciprocating motions for a plurality of cycles for leading said exhaust ink into said ink receiving member.

It is also an object of the present invention to provide an ink jet recording apparatus, comprising:

a supporting member for supporting a recording head which discharges ink on a recording medium;

ink receiving means capable of receiving ink which is located opposite to a recording head when maintaining and recovering discharge in order to maintain and recover a state of ink discharge from said recording head for discharging ink on a recording medium;

pump type transporting means consisting of a piston and cylinder which connects said ink receiving means to an exhaust ink receiving member for receiving ink exhausted by the discharge maintaining and recovery process, and transports received ink in said ink receiving means into said exhaust ink receiving member, wherein;

in said pump type transporting means, the first stroke is different from the last stroke in piston reciprocating motions for a plurality of cycles for leading said exhaust ink into said ink receiving member; and transporting means for transporting said recording medium.

It is also an object of the present invention to provide a discharge maintaining and recovery apparatus, comprising:

ink receiving means capable of receiving ink which is located opposite to a recording head and comes into contact with said recording head when maintaining and recovering discharge in order to maintain and recover a state of ink discharge from said recording head for discharging ink on a recording medium;

pump type transporting means consisting of a piston and cylinder which connects said ink receiving means to an exhaust ink receiving member for receiving ink exhausted by the discharge maintaining and recovery process, and transports received ink in said ink receiving means into said exhaust ink receiving member, control means which performs a first discharge maintaining and recovery process for exhausting ink by means of discharge not concerned in recording by driving said recording head, and a second discharge maintaining and recovery process for exhausting ink by allowing said ink receiving means to come into contact with said recording head and by driving said transporting means, wherein;

said pump type transporting means controlled by said control means has more drive in the second discharge maintaining and recovery process than in the first discharge maintaining and recovery process, and the first stroke is different from the last stroke in piston reciprocating motions for a plurality of cycles for leading said exhaust ink into said ink receiving member.

It is also an object of the present invention to provide an ink jet recording apparatus, comprising:

supporting member for supporting a recording head which discharges ink on a recording medium;

ink receiving means capable of receiving ink which is located opposite to a recording head and comes into contact with said recording head when maintaining and recovering discharge in order to maintain and recover a state of ink discharge from said recording head for discharging ink on a recording medium;

pump type transporting means consisting of a piston and cylinder which connects said ink receiving means to an exhaust ink receiving member for receiving ink exhausted by the discharge maintaining and recovery process, and transports received ink in said ink receiving means into said exhaust ink receiving member;

control means which performs a first discharge maintaining and recovery process for exhausting ink by means of discharge not concerned in recording by driving said recording head, and a second discharge maintaining and recovery process for exhausting ink by allowing said ink receiving means to come into contact with said recording head and by driving said transporting means, wherein;

said pump type transporting means controlled by said control means has more drive in the second discharge maintaining and recovery process than in the first discharge maintaining and recovery process, and the first stroke is different from the last stroke in piston reciprocating motions for plural times for leading said exhaust ink into said ink receiving member; and transporting means for transporting said recording medium.

In an ink jet recording apparatus equipped with a recording head for recording by discharging ink on a recording medium, it is also an object of the present invention to provide an ink jet recording apparatus, wherein;

plural waste ink storage members, which receive waste ink to be exhausted by the discharge recovery process in order to maintain at least a state of ink discharge of said recording head in a good condition, are provided by utilizing the empty space within the apparatus.

According to the present invention, it is possible to fully take ink in the pump from the receiving means with less counter-flow by driving the piston for the first several times, and to transport most ink from the pump into the waste ink storage member by driving the piston in full stroke for a final specified number of times.

According to the present invention, since ink, which accumulates in the ink receiving means, is transported into the waste ink receiving member midway during recording for each discharge recovery process (by predischarge) for a specified number of times during recording, the transporting operation is effective. Also an amount of ink, which accumulates in the ink receiving means by predischarge, is less than that during forced exhaust to be performed for recovering the discharge.

Therefore, idle suction during the recording process is performed fewer number of times than a number of times for transporting (idle suction) at the time, and it is effective in improving the throughput of the recording apparatus to reduce the number of times.

According to the present invention, the waste ink receiving capacity increases while the entire apparatus is miniaturized because plural waste ink tanks are installed by utilizing the empty space existing scattered within the ink jet recording apparatus as the space for the waste ink storage member.

DESCRIPTION OF THE PREFERRED EMBODIMENTS

Figure 1:
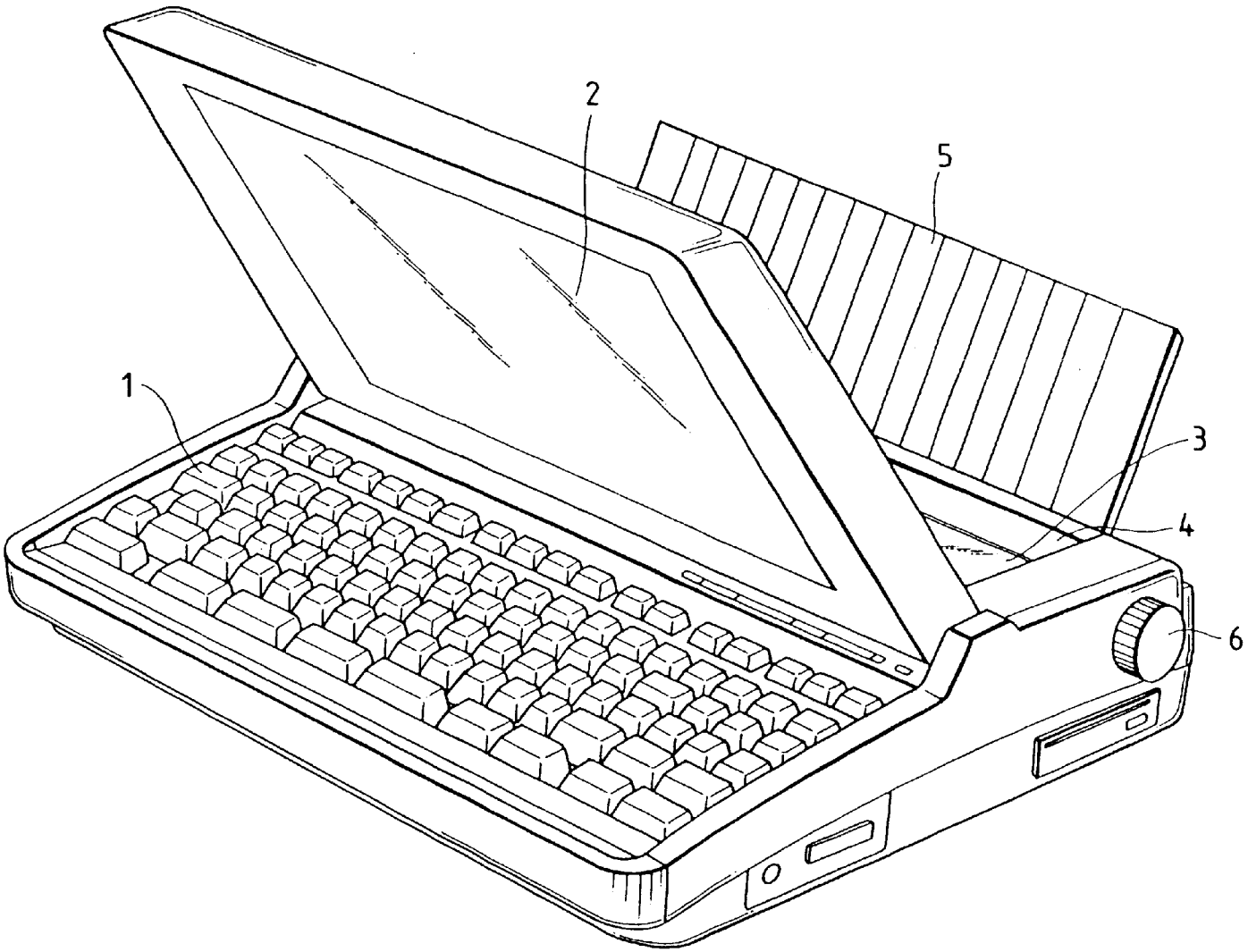
FIG. 1 is a perspective view showing the configuration of a word processor according to an embodiment of the present invention.

The present invention will hereinafter be described in detail with respect to embodiments thereof shown in the drawings.

FIG. 1 is a block diagram showing an example of a document preparing device (hereinafter called "word processor") to which the present invention can be applied.

In FIG. 1, numeral 1 indicates a key board, i.e., an input device. A display 2 for displaying an input document, etc. is rotatably held, and is folded so that the display is put on the key board 1 for storage when not used.

A transparent or semi-transparent protection cover 3, which can be opened and closed, is provided at an inspection aperture. The inspection aperture is used to check a recording head for operating condition in the recording region where recording is performed when the recording head moves relatively to a medium to be recorded. A spur cover 4 holds a spur. These will be described later in FIGS. 6 to 8.

Numeral 5 indicates a paper supporter which supports paper when supplying and exhausting recording sheets. Numeral 6 indicates a knob whereby recording sheets are manually supplied and exhausted.

Figure 2:
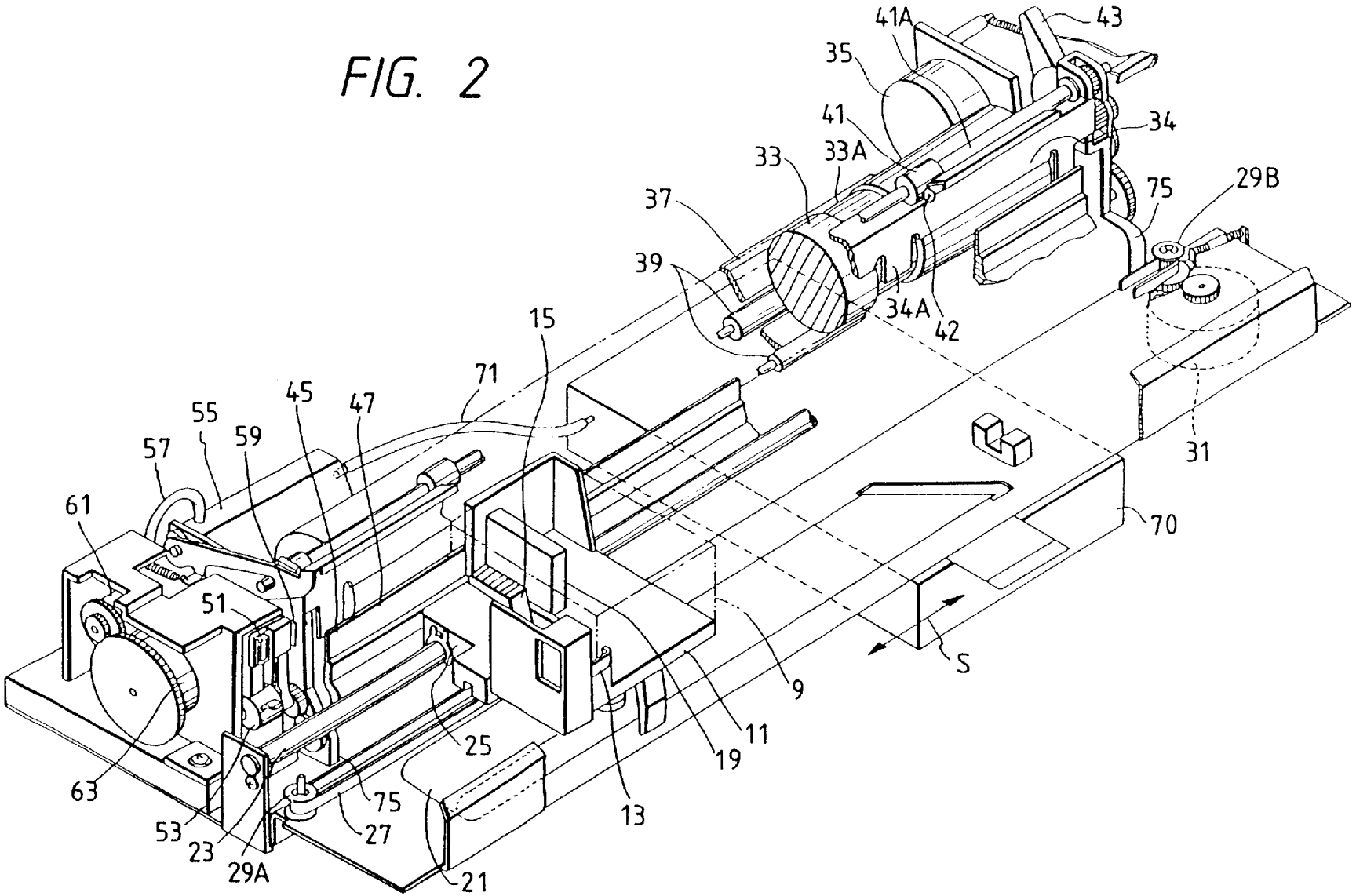
FIG. 2 is a perspective view showing an embodiment of an ink jet recording apparatus as its printer.

FIG. 2 shows an example of the configuration of a printer in an ink jet recording apparatus according to this example.

Figure 3:
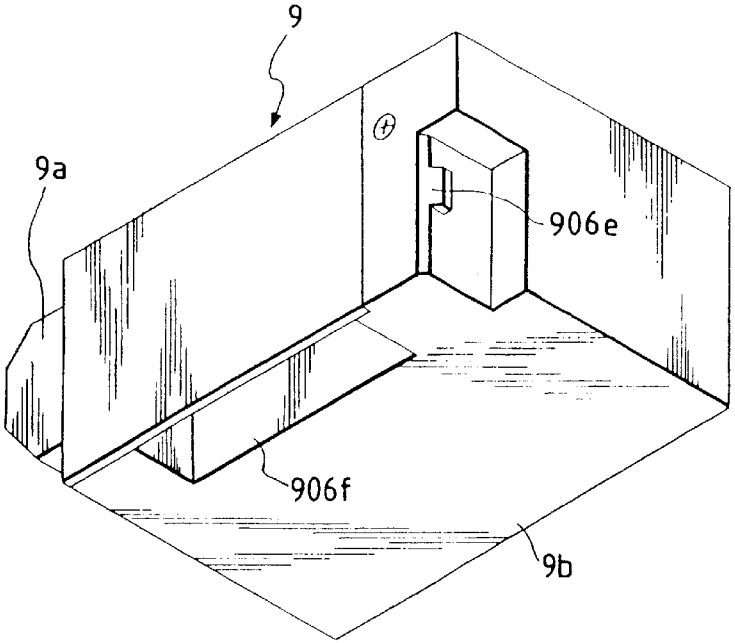
FIG. 3 is an appearance perspective view of a head cartridge shown in FIG. 2.

In FIG. 2, numeral 9 shown in alternate long and short dash line is a head cartridge having an ink jet recording head as described in detail in FIGS. 3 and 4, and a carriage 11 scans loaded with the head cartridge in the S-direction in FIG. 2. A hook 13 installs the head cartridge 9 to the carriage 11. A lever 15 controls the hook 13. A supporting plate 19 supports an electric connection to the head cartridge 9. A FPC 21 is used to connect the electric connection to the main body control unit. The configuration concerning this FPC will be mentioned later in FIGS. 9 to 11.

A guide shaft 23 guides the carriage 11 in the S-direction, and is inserted through a bearing 25 of the carriage 11. The carriage 11 is secured, and a power to move the carriage in the S-direction is transmitted by a timing belt 27, which is laid over pulleys 29A and 29B located on both sides of the apparatus. To one pulley 29B, a driving force is transmitted through a transmission mechanism such as gears from a carriage motor 31.

A conveyance roller 33 controls a surface to be recorded of a recording medium (hereinafter also called "Recording sheet") such as paper and OHP paper, also conveys the recording medium during recording, etc., and is driven by a conveyance motor 35. A paper pan 37 guides the recording medium to the recording position from a paper supporter 5 side.

Feed rollers 39 are placed midway on the transporting path for the recording medium to press the recording medium against the conveyance roller 33 for conveying. A platen 34 is opposed to the discharge port of the head cartridge 9 to control the recording surface of the recording medium. An exhaust paper roller 41 is located on the downstream side from the recording position in the direction of conveying the recording medium to exhaust the recording medium toward an exhaust paper port (not illustrated).

A spur 42 is provided against the exhaust paper roller 41, and presses the roller 41 through the recording medium to generate a force for conveying the recording medium by means of the exhaust paper roller 41. A release lever 43 releases the energization for the feed roller 39 and spur 42 respectively when setting the recording medium.

A platen 34 is rotatably supported at both ends by the shaft of the exhaust paper roller 41, and is energized toward the front surface 45 of the paper pan 37 from the stop position of left and right plates 75 and 75. When there is no recording sheet tabs, 34A, which are located opposite to portions 33A smaller than the extreme outer periphery of the platen roller 33, are in contact with the inner side of the front surface 45 of the paper pan.

A cap 51, formed with elastic material such as rubber, is opposed to the ink discharge port formation surface of the recording head at the home position, and is supported so that it can come into contact with or leave the recording head. This cap 51 is used to protect the recording head when not recorded, etc., and to perform the discharge recovery process for the recording head.

The discharge or suction recovery process is to discharge ink from all discharge ports by driving an ink discharge energy generating element provided inside the ink discharge port while the cap 51 is opposed to the discharge port formation surface, to remove (predischarge) improper discharge factors such as ink unsuitable for recording owing to entry of air bubble or dust or thickening caused thereby, and in addition, to remove an improper discharge factor by forcibly discharging (sucking) ink through the discharge port while the discharge port formation surface is covered with the cap 51.

A pump 53 applies a suction force to forcibly discharge ink, and also sucks ink received in the cap 51 during suction recovery process by such a forcible exhaust and discharge recovery process by predischarge. A first waste ink tank 55 stores waste ink sucked in by the pump 53, and a tube 57 is used to communicate between the pump 53 and the waste ink tank 55. A second waste ink tank 70 is connected to the first waste ink tank 55 through tube 71.

A blade 59 wipes the discharge port formation surface of the recording head, and is movably supported between a position for wiping by projecting on the recording head side during the head movement and a retracted position not in contact with the discharge port formation surface. Numeral 61 is a motor. A cam unit 63 is driven by the motor 61 to drive the pump 53 and move the cap 51 and blade 59 respectively.

The head cartridge 9 will be described in detail below.

FIG. 3 is an appearance perspective view of a head cartridge 9 obtained by uniting a discharge unit 9*a*, the ink jet recording head main body, and an ink tank 9*b* into one. In FIG. 3, numeral 906*e* is a pawl which engages a hook 13 provided in the carriage 11 when mounting the head cartridge 9. As can be seen from FIG. 3, the pawl 906*e* is placed inside the full extension of the recording head.

In the vicinity of the discharge unit 9*a* ahead of the head cartridge 9, there is a positioning knockout (not illustrated) provided. A head opening 906*f* is vertically installed to the carriage 11, and a supporting plate, which supports a flexible substrate (electric connection) and rubber pad, is inserted into the head opening.

Figure 4B:
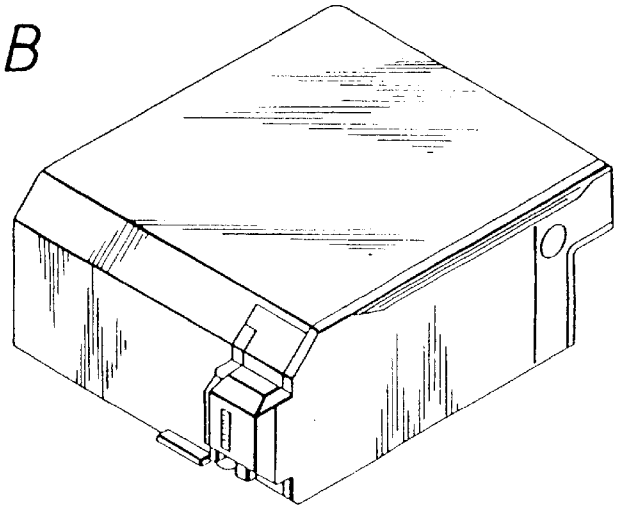
FIGS. 4A and 4B are disassembly and appearance perspective views, respectively, of a head cartridge shown in FIG. 3.
Figure 4C:
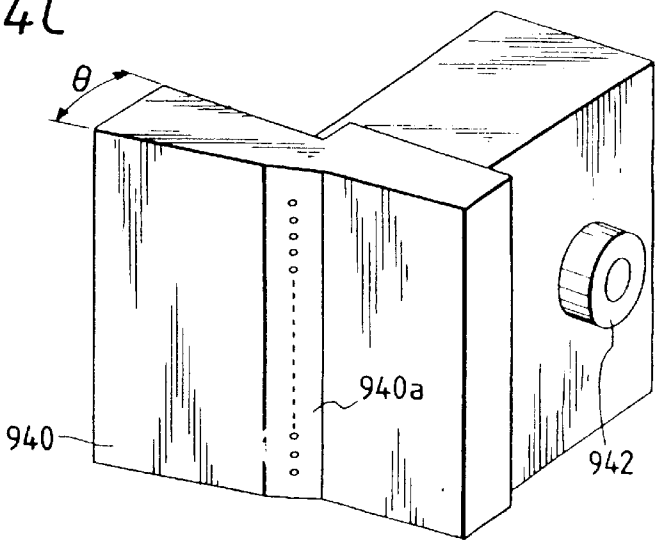
FIG. 4C is a perspective view of an example of a configuration of a recording head top in FIG. 4A.
Figure 4A:
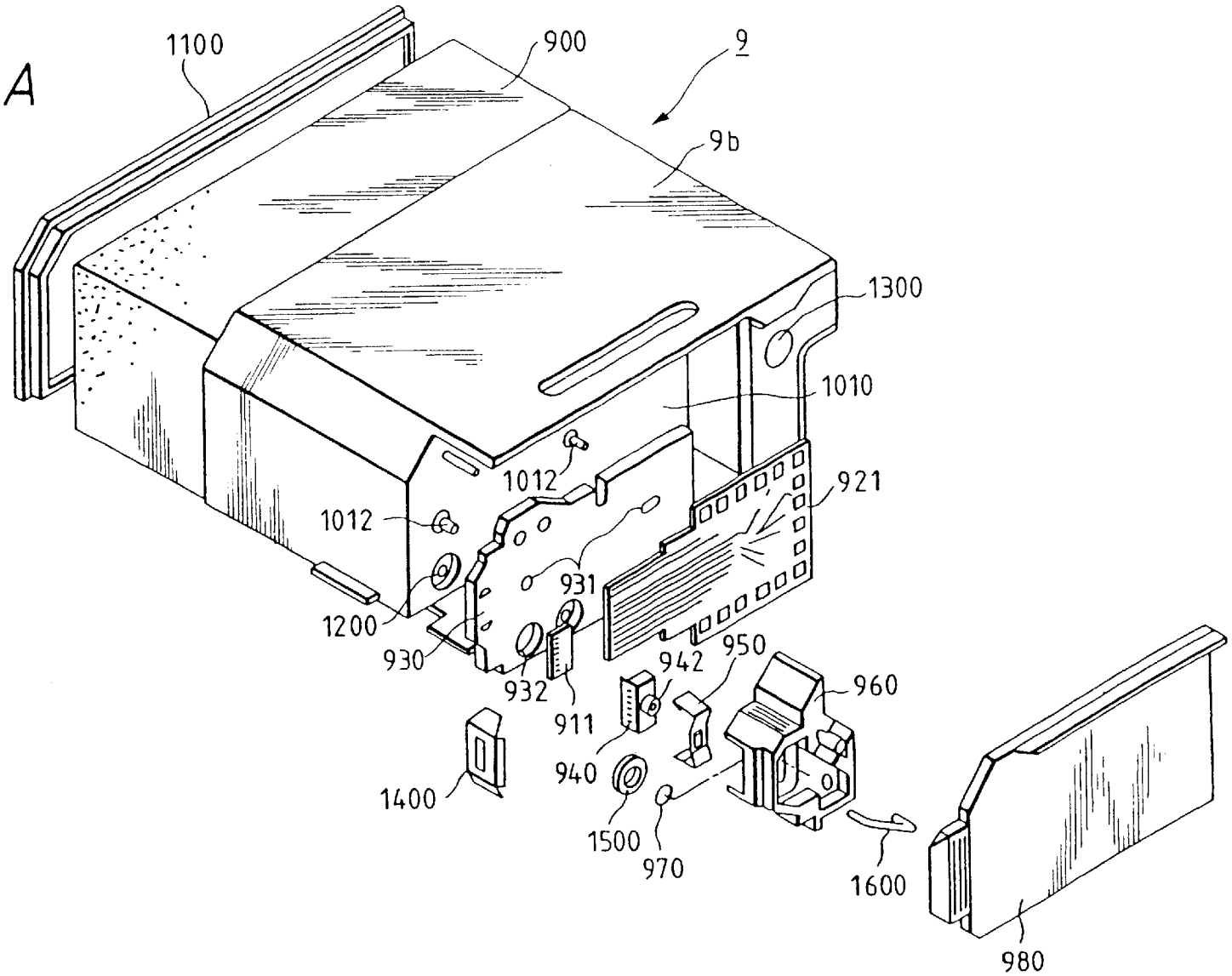

FIGS. 4A and 4B are assembly perspective views of the head cartridge shown in FIG. 3, and the head cartridge is of the disposable type by integrating an ink receiving unit and ink supply source into one as mentioned above.

In FIG. 4A, a heater board 911 is formed from a electro-thermal converting member (discharge heater) and wiring such as A1, through which electric power is supplied to the electro-thermal converting member, on a Si substrate by using the film forming technique. Numeral 921 is a wiring substrate for the heater board 911, and the corresponding wiring is connected by wire bonding, for example.

A top 940 is provided with a partitioning, which limits the ink flow path, common liquid chamber, etc., and the top incorporated with an orifice plate into one is made of resin material in this example. As shown in FIG. 4C, the discharge port formation surface inclines by a specified angle θ against a plane parallel with the surface to be recorded of the recording sheet, and has a difference in level 940*a* in a portion near the discharge port. This has been done in view of the following: to work the discharge port by irradiating a laser beam from the flow path side provided at the top, the flow path in the orifice plate and a flow path behind the flow path make a specified angle.

Numeral 930 is a base material made of metal, for example, and numeral 950 is a hold-down spring. The heater board 910 and top 940 are pressure fitted for securing by means of the energizing force of the hold-down spring 950 by engaging the base material with the hold-down spring while the heater board 911 and top 940 are held between both.

The base material 930 is provided with the wiring substrate 921 by pasting, etc., and also can have a positioning reference for the carriage 11 which scans the head. The base material 930 also functions as a member for radiating the heat generated from the heater board 911 by driving for cooling.

A supply tank 960 receives ink from an ink storage unit 9*b*, ink supply source, and functions as a subtank to guide ink into a common liquid chamber formed by bonding the heater board 911 to the top 940. A filter 970 is located within the supply tank 960 near the ink feed port to the common liquid chamber. Numeral 980 is a cover member for the supply tank 960.

An absorber 900 impregnates ink, and is located within the ink tank main body 9*b*. An ink feed port 1200 feeds ink into a recording element 9*a* consisting of the above-mentioned each portion 911 to 980. In a process before locating said unit in a portion 1010 of the ink tank main body 9*b*, pouring ink through the feed port 1200 impregnates ink into the absorber 900.

Numeral 1100 indicates a cover member for the cartridge main body, and numeral 1300 indicates an air communication port provided at the cover member to communicate the inside of the cartridge to air.

After filling the ink tank 9*b*, with ink through the feed port 1200, the discharge unit 9*a* consisting of each portion 911 to 980 is positioned to the portion 1010 for placing. The positioning or fixing at this time can be performed by fitting a projection 1012, for example, provided in the ink tank main body 9*b* in a hole 931 drilled in the base material 930 corresponding thereto, and thereby the head cartridge 9 shown in FIG. 4B is completed.

Ink is fed from the inside of the cartridge into the supply tank 960 through the feed port 1200, a hole 932 drilled in the base material 930 and an inlet provided on the rear side of the supply tank 960 shown in FIG. 4A. Then ink passes through the inside of the supply tank, and then flows from the outlet into the common liquid chamber through an appropriate feed pipe and ink inlet 942 of the top 940. At the above-mentioned connections for communicating ink, packings made of silicone rubber or butyl rubber, etc., for example, are placed, and thereby sealing is performed to secure the ink feed path.

Figure 5:
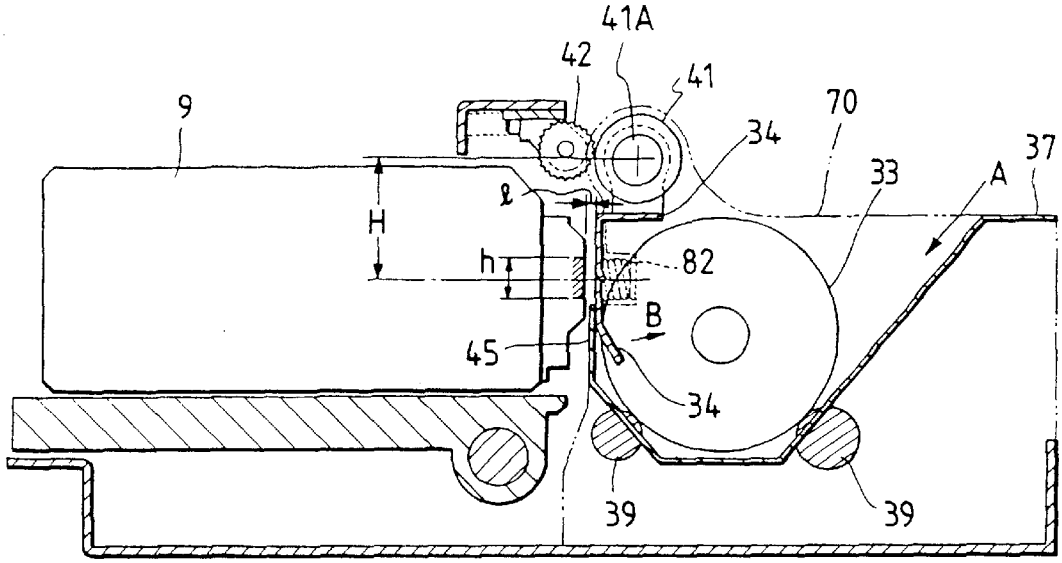
FIG. 5 is a sectional side view of a printer for describing head gap adjusting means according to this example.

FIG. 5 is a schematic cross-sectional view of FIG. 2. The configuration and operation of the platen 34 and the paper pan front surface 45 will be described in detail.

A distance 1 (head gap) between the discharge port of the head cartridge 9 and the front surface of the platen 34 has been adjusted to be optimum for printing.

Under the above configuration, a recording sheet inserted from A-direction is energized toward a roller 33 by the feed rollers 39, and is fed by its frictional force. The tip of the recording sheet enters between a rake 34A of the platen and the inside of the paper pan front surface 45 while rotating the platen 34 in the B-direction with a shaft 41 A as the center shaft of rotation against the force of springs 82 (provided on both sides). A clearance between the front surface 45 and the discharge port formation surface has been properly adjusted and fixed.

Therefore, an optimum head gap between the recording sheet on the platen 34 and the discharge port of the head cartridge 9 can be maintained by the relief of the platen 34 in the B-direction irrespective of the thickness of the recording sheet.

In the extension line of the front surface of the platen 34, there is contact between the exhaust sheet roller 41 and the spur 42 even in the case of the relief in the B-direction by means of the thickness of the recording sheet, and the tip of the recording sheet easily can enter between the exhaust sheet roller 41 and the spur 42. The difference h in the head gap between up and down of the recording unit caused by the inclination of the platen can be ignored because a distance H between the center of rotation of the platen and center of printing is great.

The platen 34 is not always required to be coaxial with the roller 41. For the front surface 45, any other than a front surface molded by integrating with the paper pan 37 into one may be used, and one secured by bonding or fastening using machine screws may be also used. Also one separately constructed and secured by another portion of the apparatus may be used.

Figure 6:
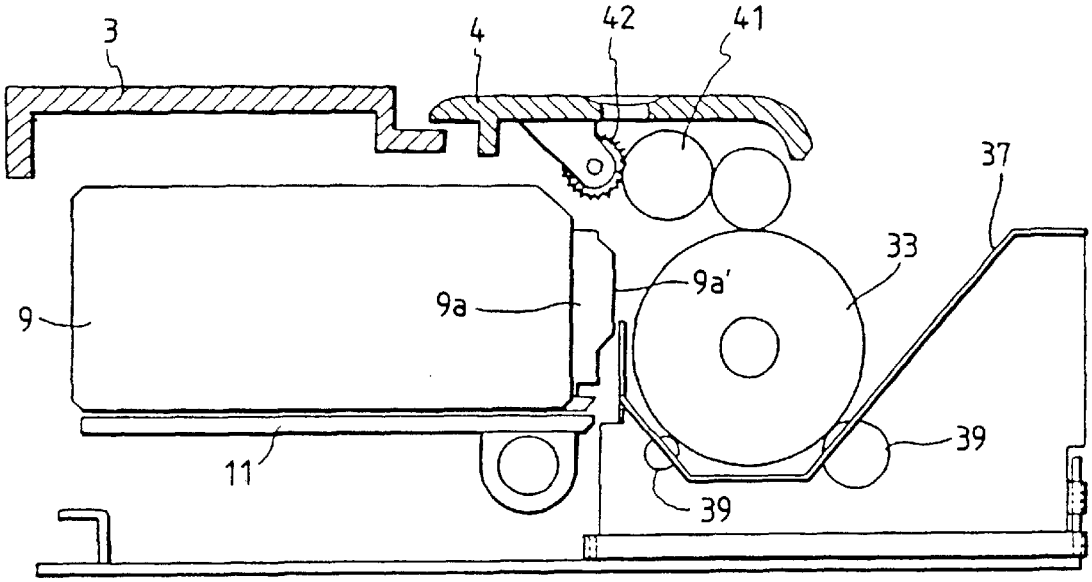
FIG. 6 is a sectional side view of a printer for describing a spur cover and inspection window according to this example.

FIG. 6 is a schematic cross-sectional view showing a printer with the head cartridge 9 mounted, and equipped with a spur 42, spur cover 4 and protection cover 3 provided at the inspection aperture.

As can be seen from FIG. 6, the spur cover 4 overhangs the head cartridge 9 to form a spur securing unit.

Therefore, if the cover 3 is transparent or semitransparent, the operation of the head cartridge 9 can be visually inspected while the cover is put on. It is, however, desirable that the ink discharge portion 9*a*' of the discharge unit 9*a* at the capping position can be also inspected visually.

Figure 7:
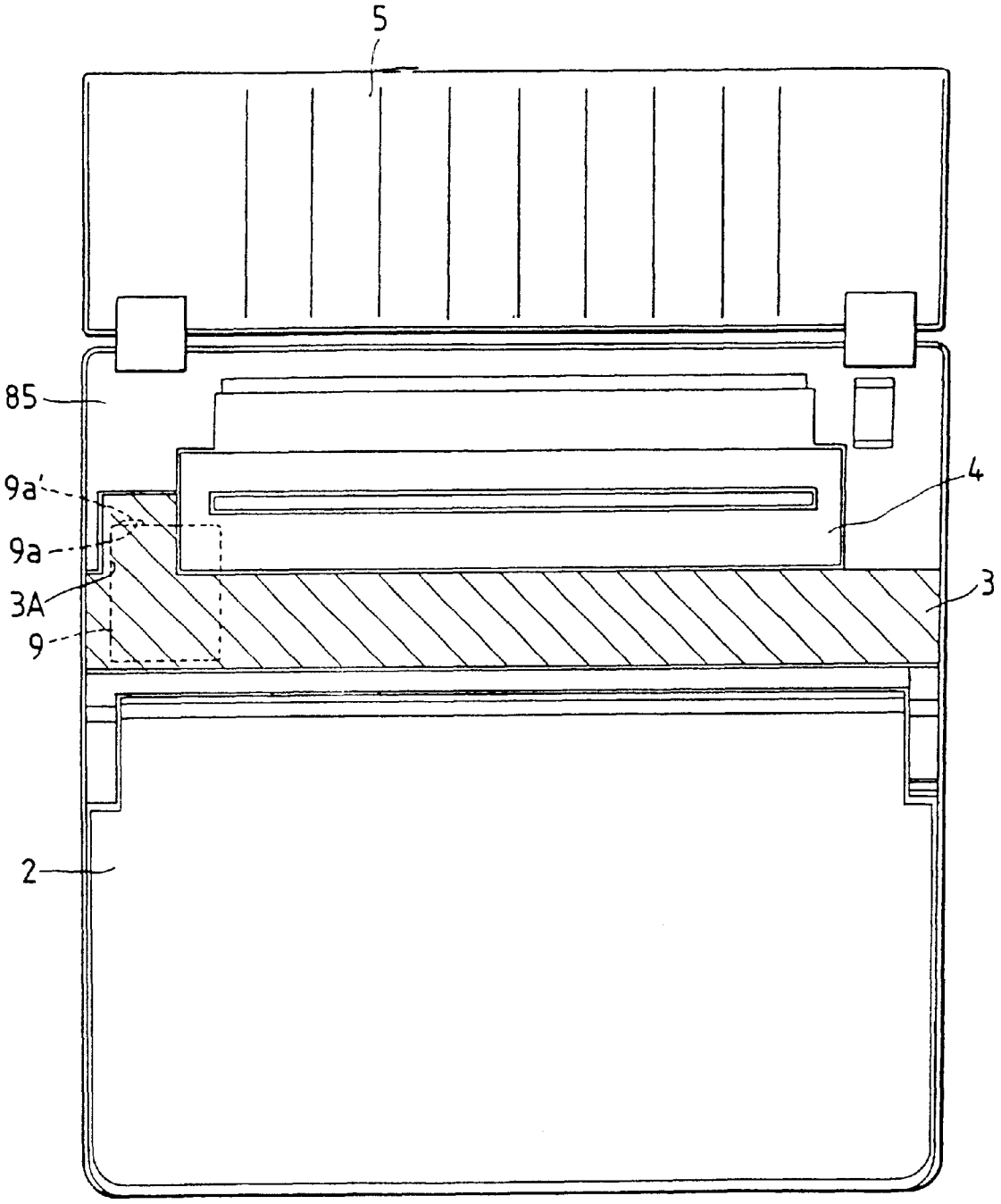
FIG. 7 is a top view of a printer for describing a spur cover and inspection window according to the comparative example.

In the configuration of FIG. 7 adopted in this embodiment, the ink discharge portion 9*a*' can be visually inspected by spreading the inspection aperture 3A in the width direction and also making the inspection aperture L-shaped enough to further cover above the ink discharge portion 9*a*'.

In this example, the inspection aperture 3A is provided with a cover member 3 to protect the inside of the apparatus such as the head cartridge 9 even at the nonprinting position. This cover member 3 may be made of various materials, and making this transparent or semitransparent enables visual inspection during capping while the cover is put on.

If, however, the cover member 3 is constructed so that it can be opened and closed or be easily attached and detached and can be immediately opened as required, it may not always be transparent or semitransparent.

Now the configuration relating to the above-mentioned FPC21 will be concretely described.

Figure 8:
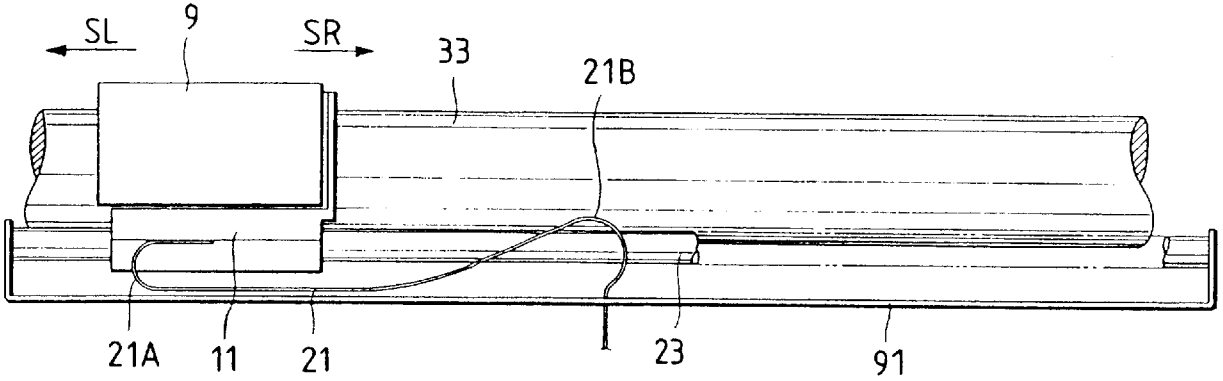
FIGS. 8 and 9 are front views of a printer for describing means to prevent FPC insertion according to this example.
Figure 9:
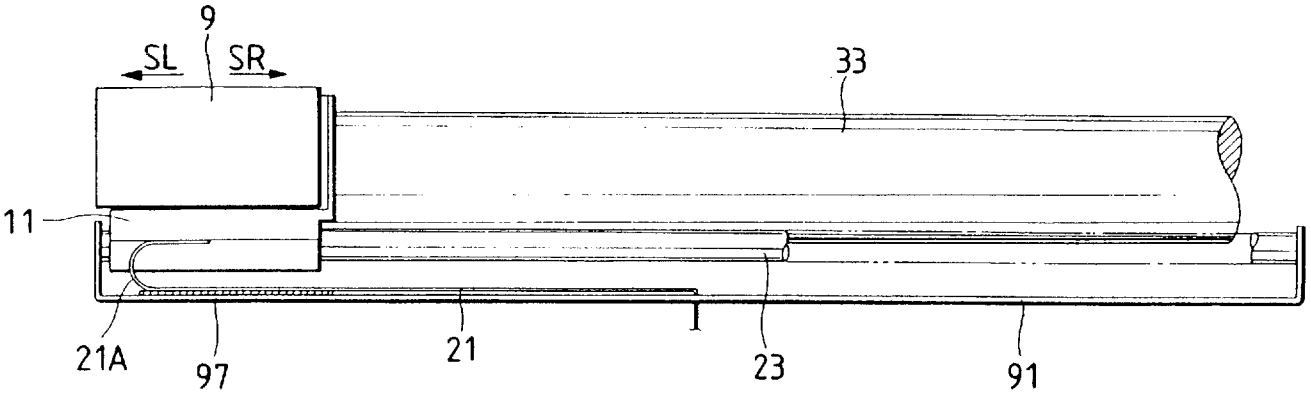
Figure 10:
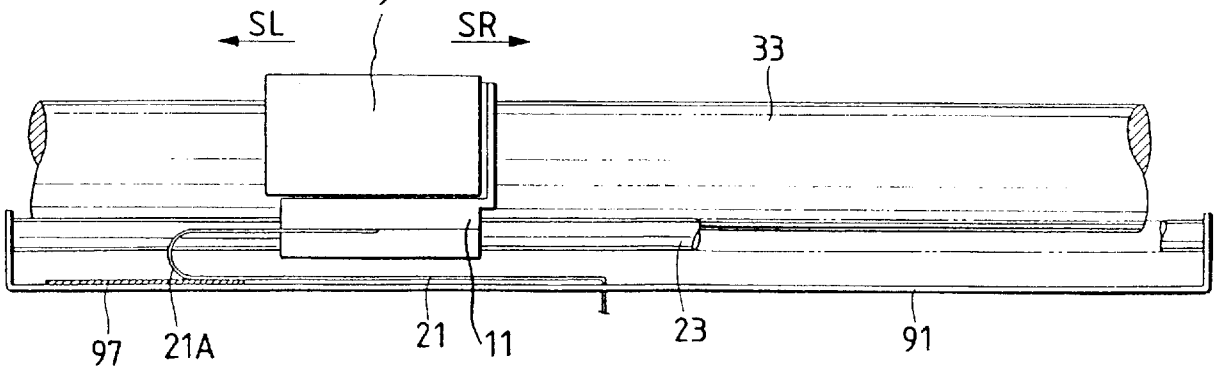
FIG. 10 is a front view of a printer for describing FPC insertion according to a conventional configuration.

FIGS. 8 and 9 are schematic front views of the recording apparatus according to the embodiment, and FIG. 10 is a schematic front view of the recording apparatus according to the comparative example.

In FIG. 8, a conveyance roller 33 extending right-to-left is provided on a right and left frame 75 (not illustrated in FIG. 8) vertically installed on a frame 91 of the recording apparatus. This guide shaft 23 is likewise secured on this side of the roller 33, on top of which the carriage 11 is provided so that it can slide right-to-left, and the head cartridge 9 is mounted on the carriage 11 as mentioned above.

On the carriage 11, FPC21 is secured which electrically connects a control circuit (not illustrated) with the head cartridge 9 through a connector, etc. installed thereon. Also the other end of FPC21 is secured to the frame 91.

Further between FPC21 on the frame 91 and the frame 91, a friction sheet 97 is provided near an area where FPC21 forms a minimum radius. The friction sheet 97 is applied with an additive on one side, and the side is bonded to the frame 91 by the additive.

In such a configuration, the carriage 11 moves on the conveyance roller 33 in the arrow SR direction in FIG. 8 by driving means such as a motor 31, etc. At this time, a recording signal is given from the control unit to the discharge unit 9*a* of the head cartridge 5 mounted on the carriage 11 through FPC21. The discharge unit 9*a* discharges ink on the recording sheet on said signal for recording. After completing recording for one line, the carriage 11 stops, the roller 33 is rotated by driving means such as a motor 35, and accordingly the recording sheet is sub-scanned.

Hereafter, the carriage 11 moves in the arrow SL direction in FIG. 8, and the next line will be recorded.

FIG. 9 shows the state of the movement. In this example, since the friction sheet 97 is provided on the frame 91, a friction force occurs between FPC21 and the friction sheet 97. FPC21 does not slip on the frame 91, but an arc portion 21A properly moves, and therefore FPC21 is not caught in the lower portion of the carriage 11.

In a configuration in which no friction sheet 97 is provided as shown in FIG. 10, on the other hand, there is slippage between FPC21 and a frame 1 under the carriage 11, causing slack 21B on FPC21. When the carriage further moves in the right direction (SR direction) in this state, FPC21 is likely to be caught in the carriage 11.

According to this example as mentioned above, the travel of FPC21 can be stabilized by adopting such a simple configuration that a member (friction sheet 97) with a high friction coefficient is provided on the frame 91 of the recording apparatus. Accordingly it is possible to set the height of FPC traveling unit low, and to provide a small-sized and light-weight recording apparatus.

As an example of the friction sheet 97, sheet material consisting of silicone, for example, can be used.

In the above description, FPC was used to connect between the head cartridge 9 and the control circuit. However, not only FPC but also all electrical connection members such as flat cable and flux wire can, of course, be used.

Figure 11:
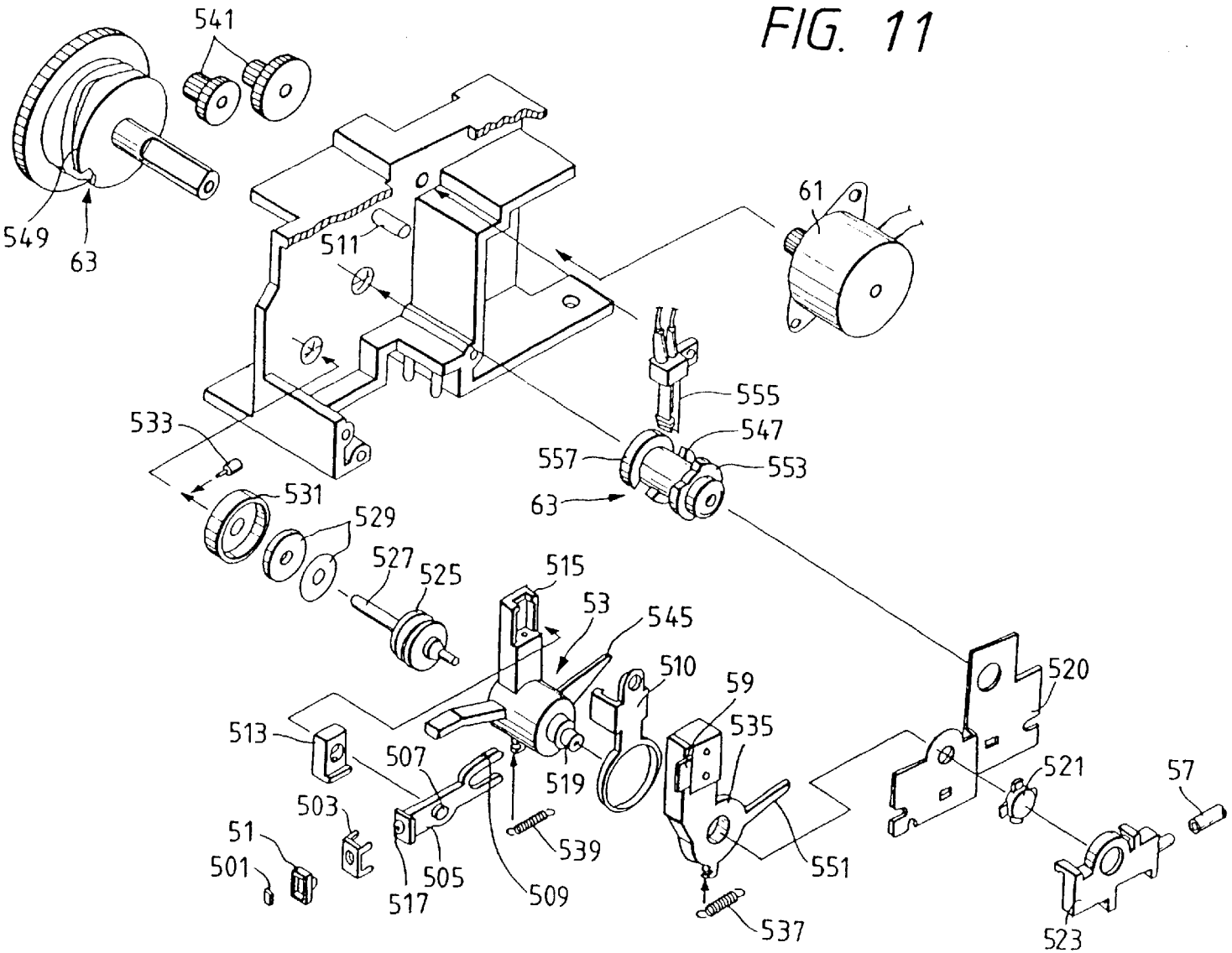
FIG. 11 is a disassembly perspective view of a discharge recovery mechanism shown in FIG. 2.

FIG. 11 is a disassembly perspective view of the major portion of the recovery apparatus consisting of a cap 51, pump 53, blade 59, motor 61, cam device 63, etc. in FIG. 2.

In FIG. 11, an ink absorber 501 is located within a cap 51, and a holding member 503 holds the cap 51. A cap lever 505 is rotatably installed with a pin 507 as the center, and allows a cap 51 to come into contact with/leave the port discharge port formation surface of the discharge unit 9*a* by means of a force applied to the pin 507. A pin 511 engages the end 509 of the cap lever 505 to control the range of rotation of the cap lever 505.

A jig 513 has a hole into which a pin 507 of the cap lever 505 is fitted, and is used to install the cap lever 505 to a supporting unit 515 provided at pump 53. A locking member 516 secures its installation state. An operation unit 517 applies a force, which abuts the discharge port formation surface, to the cap 51, and engages almost the center of the rear side of the cap 51.

This operation unit has an inlet 517A for sucked ink, and an ink flow path is formed within each of the cap lever 505, pin 507, jig 513 and supporting unit 515. When the pump 53 applies the suction force, ink flows into the pump 53 through these flow paths as shown by the arrow in FIG. 11.

A shaft 519 projects from the center of the end surface of the pump 53, having an ink flow path formed inside, and is rotatably installed to the sidewall 520. The rotating force of the pump 53 itself thereby is applied to the cap lever 505 through the supporting unit 515, and the cap 51 advances or retracts accordingly. A flow path formation member 521 is combined with the pump shaft 519. Numeral 523 indicates a fitting member for a tube 57. In other words, an ink flow path is formed within the shaft 519, flow path formation member 521 and fitting member 523. Ink sucked in by the pump 53 is led into the waste ink tank 55 through the flow path and tube 57 as shown by the arrow in FIG. 11.

Numeral 525 is a piston of the pump 53, 527 is a piston shaft, 529 is packings, and 531 shows a cap for pump 53.

A pin 533 is fitted to the piston shaft 527, and receives a force which operates the piston 525.

A blade lever 535 is fitted with blade 59, and is rotatably supported around the shaft projecting from the end surface of the pump 53 to allow the blade 59 to project or retract on the recording head side with said rotation. A spring 537 provides the blade lever 535 with a rotating force in a direction of projecting the blade 59. Another spring 539 biases the pump 53 to rotate in a direction in which the cap 53 faces toward the recording head side.

A gear train 541 transmits the rotation of a motor 61 to a cam device 63. The cam device 63 has a cam 547 which engages an engaging unit 545 provided at the pump 53 to rotate it, a cam 549 which engages a pin 533 provided at the piston shaft 527 of the pump 53 to operate the pump, a cam 553 which engages an engaging unit 551 provided at a blade lever 535 to rotate it, and a cam 557 which engages a switch 555 for detecting the home position of the cam device 63. The operation of these cams will be described later.

Figure 12:
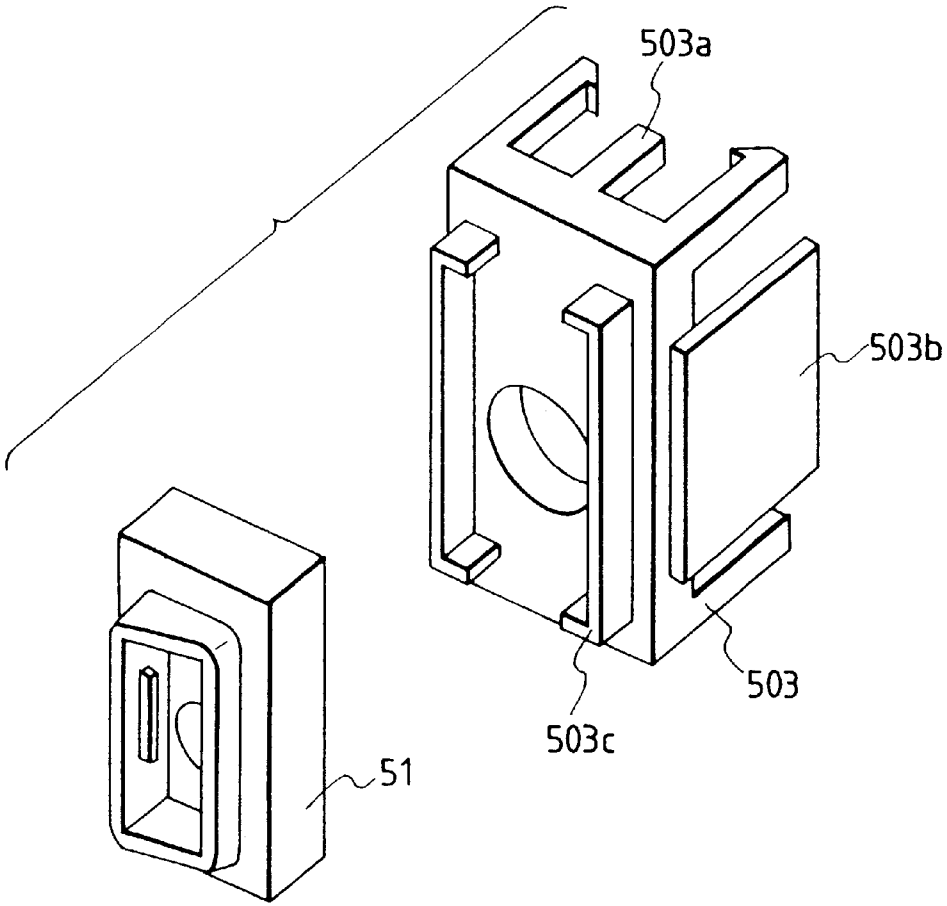
FIG. 12 is a perspective view showing the details of the cap and cap holder.

FIG. 12 is a perspective view showing the details of the cap 51 and holder 503.

The cap 51 according to this example is made of rubber-like elastic material to improve the adhesion with the orifice plate of the top 940, and is pressed against the orifice plate of the top by a pressing force of 60 to 80 g during capping. The tip of the rib portion, that is, the edge opposed to the discharge port formation surface is formed in parallel in this example to cope with the above-mentioned angle of inclination θ (See FIG. 4C), and has a trapeziform cross section, which is small at the tip and is large at the root, to follow the difference in level at the discharge port position.

Also to cope with the angle θ and prevent side slippage when pressed against the top 940, the cap holder 503 is provided with ribs 503*b* and 503*c*. That is, the rib 503*c* prevents deformation of the cap itself made of rubber, and also the rib 503*b* prevents the cap 51 and cap holder 503 as a whole from turning sideways at the cap lever 505 mounting surface.

Figure 13A:
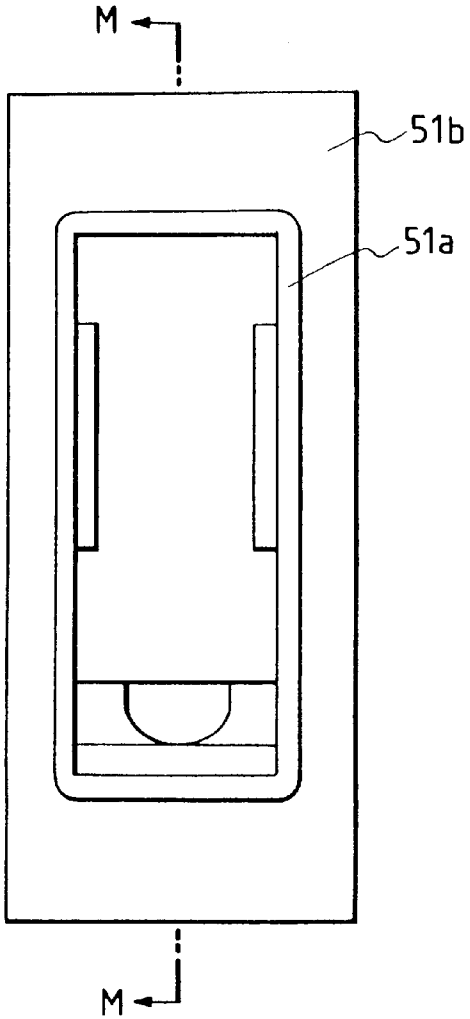
FIGS. 13A, 13B and 13C are a front view plan view and sectional side view, respectively, of a cap according to this example.
Figure 13B:
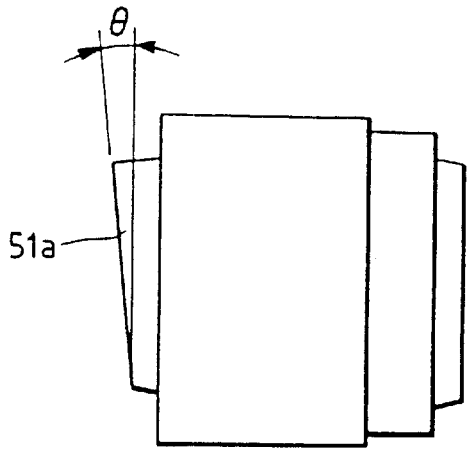
Figure 13C:
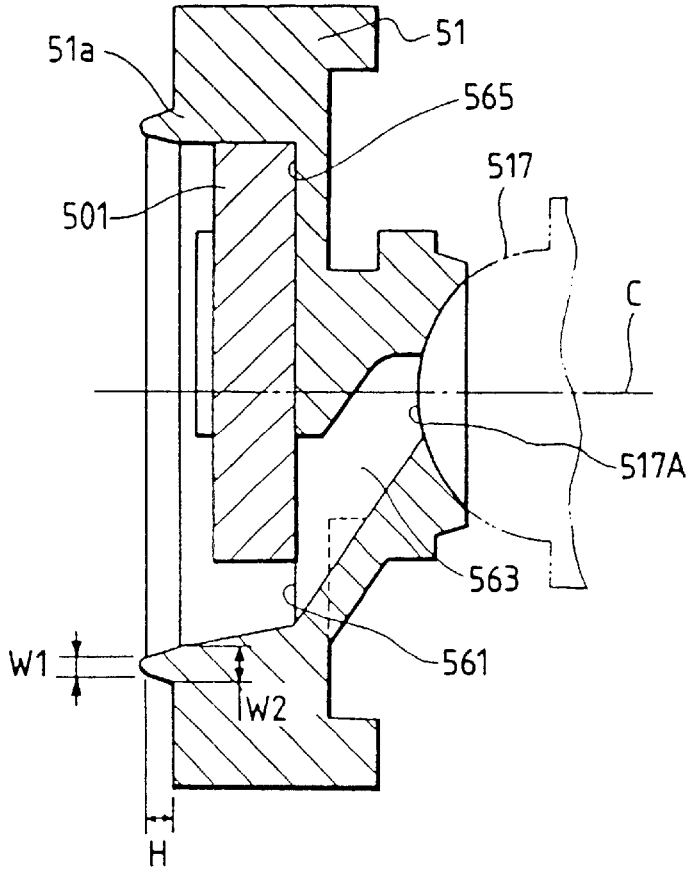

FIGS. 13A, 13B and 13C are a front view, plan view, and M-M sectional side view, respectively, showing a further detailed configuration of the cap 51.

In this example, an ink suction port 561 within the cap is provided in the lower part in the vertical direction, and an ink flow path 563 is formed toward the ink input 517A provided at the operation unit 517 of the cap lever 505. The suction port 561 is also constructed so that it is not completely covered by the absorber 501.

The head cartridge 9 set on the carriage 11 is driven by the carriage motor 31 so that its discharge port comes almost to the center of the cap 51 of the recovery system in order to recover a series of improper discharges such as capping, predischarge or suction operation.

As mentioned above in FIG. 4C, the top 940 of the head is not level against the surface to be recorded on a recording medium, that is, not at right angles with the cap pressing direction, but has a certain angle θ (θ≈5° in the case of this embodiment) and also a minute difference in level (about 0.2 mm in the case of this embodiment).

In addition, the stop position of the carriage 11 may have a deviation of a specified amount (for example, about ±0.5 mm) to the target position when a step motor is used for the carriage motor 31.

To follow the shape of the orifice plate of the top 940, a small rib with low hardness is preferable for the tip rib 51*a*, but at the same time to hold the sealing performance against a negative pressure that occurs during suction, the rib 51*a* requires a certain strength. Also since the orifice plate O of the top 940 has an angle θ, a force in a direction of expanding the rib is always applied to the rib 51*a* of the cap 51, and a permanent deformation when it has been left to stand alone for a long period is a problem.

Taking these into consideration, the shape of the rib 91*a* was selected as below in this example. The above problem was solved by using $W_1$=0.3 mm, $W_2$=0.5 mm and H=0.4 mm, and setting the rubber hardness to 60° in FIG. 13C. These values are, of course, not limited to these, but various values can be taken so long as the above effect is obtained. Values of $W_1$=0.2 to 0.6 mm, $W_2$=0.3 to 0.8 mm, and H=0.2 to 0.6 mm, for example, can be taken.

At the same time, the rib surrounding area 51*b* should be sufficiently large for the shape of the rib. The above effect can be more securely obtained by having the rib surrounding area 51*b* 2 to 3 mm or more in width and 2 to 3 mm or more in thickness, for example.

For the rubber used for the cap, butyl rubber, chlorinated butyl rubber, silicone rubber, etc. may be used.

The discharge port formation surface may not always be parallel with a plane formed by the edge of the rib portion. If parallel, the entire edge comes into contact with or leaves the discharge port formation surface at the same time when the cap 51 abuts or leaves, and a great pressure fluctuation instantaneously occurs in the space enclosed by the cap 51. For this reason, the ink meniscus within the discharge port is likely not to be properly maintained. In other words, if not parallel, the edge will gradually come into contact with the discharge port formation surface before the whole is in the state of adhesion on capping. Also during open cap, the edge will gradually leave before leaving is completely performed.

From this viewpoint, the cap configuration shown in FIGS. 12 and 13 is not always applied only to such a discharge port formation surface as shown in FIG. 4C. That is, the above cap configuration is also applicable to a discharge port formation surface formed in parallel with the non-recording surface of a recording medium, for example.

Also from the above viewpoint, any other directions than shown in FIGS. 12 and 13 may be taken for a plane formed by the edge, and any appropriate direction can be taken. Moreover, it may not always be a plane, but a configuration, in which irregularities are provided on the edge, may be used.

The recovery system will be described.

Figure 14:
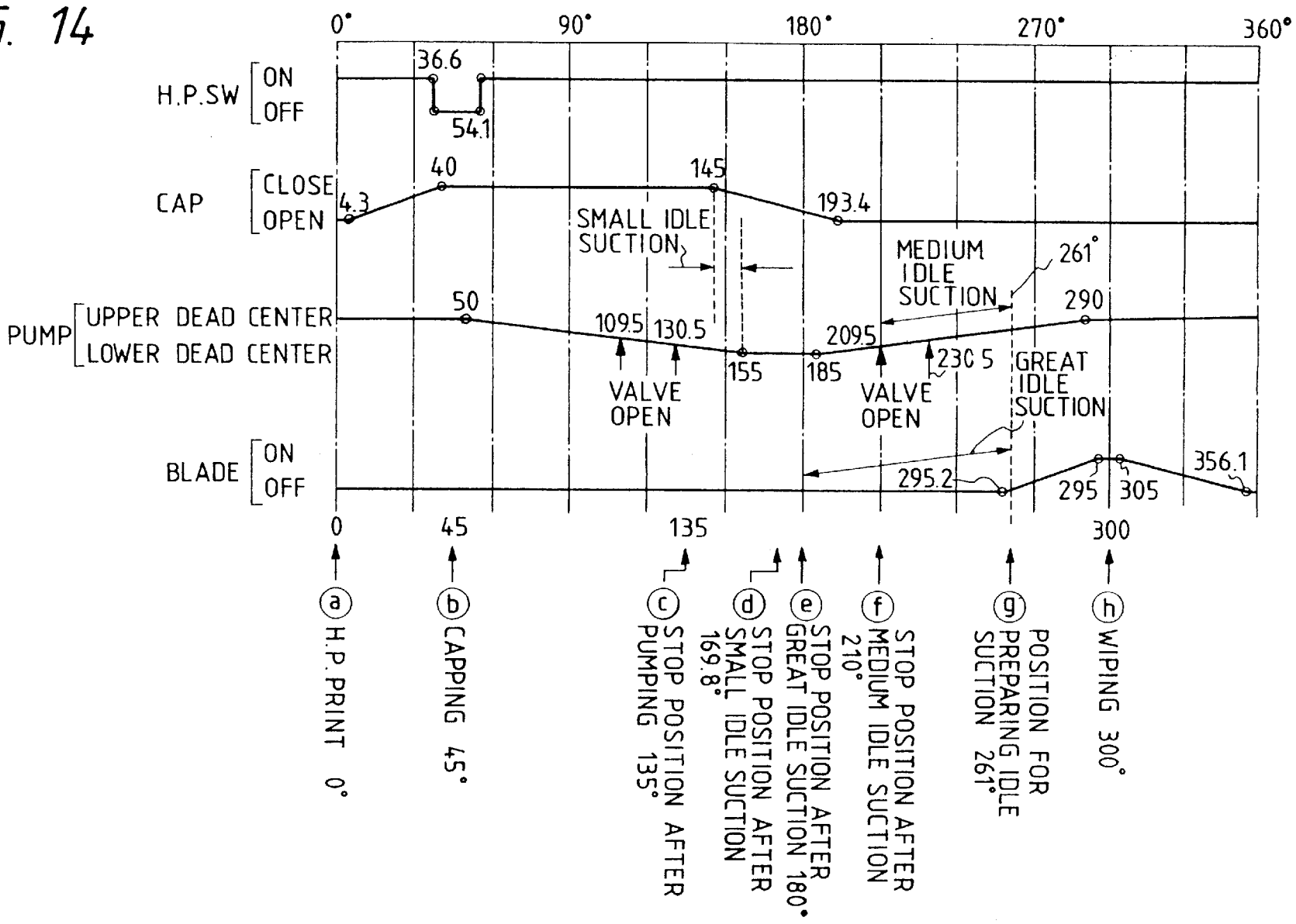
FIG. 14 is an explanatory drawing of the contour curves of cams which operate each portion of the discharge recovery mechanism.
Figure 15:
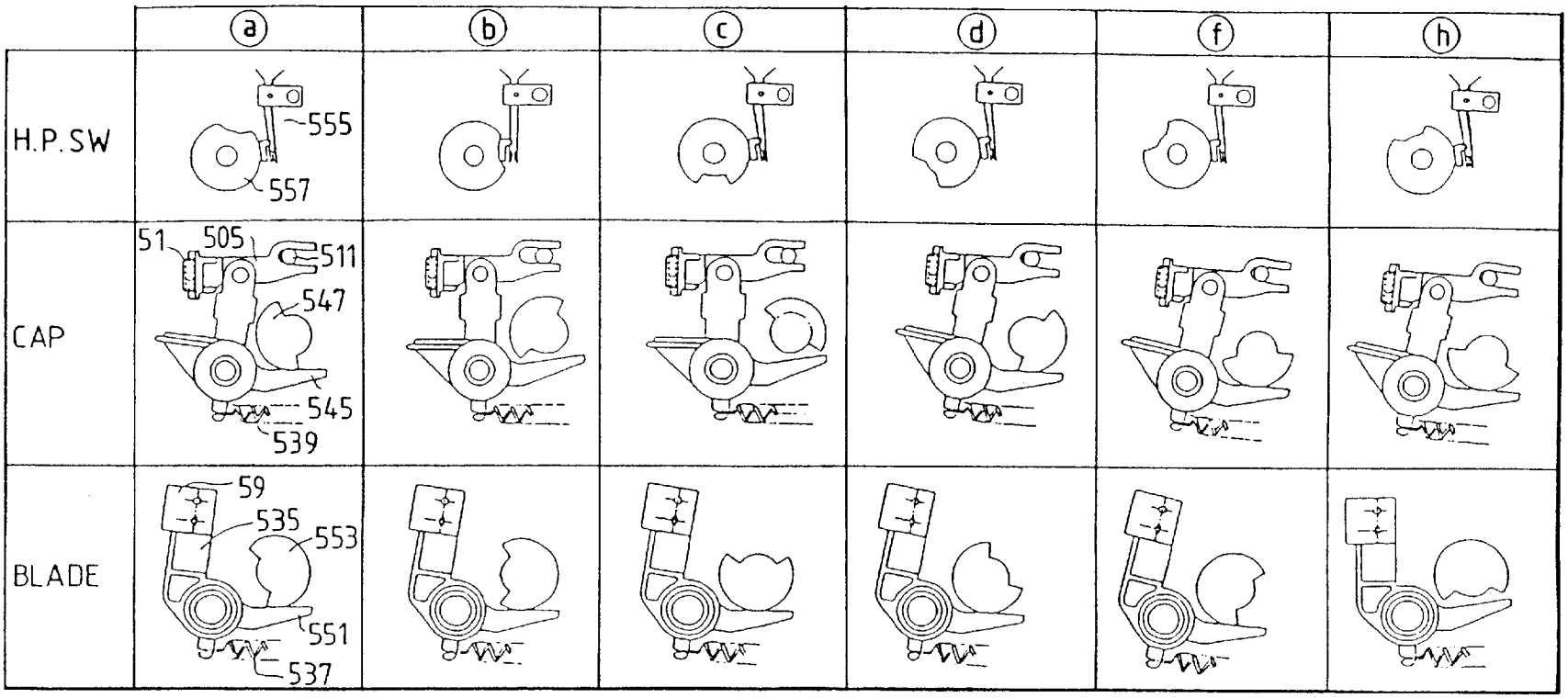
FIGS. 15 and 16 are explanatory drawings which describe the operation of each portion in major cam positions.
Figure 16:
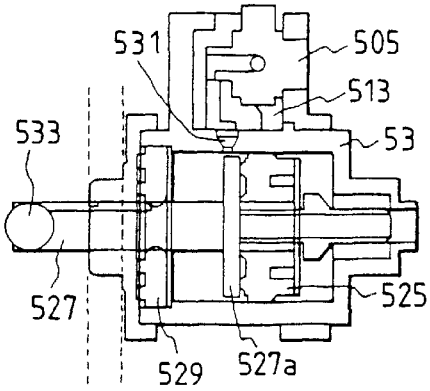
Figure 16:
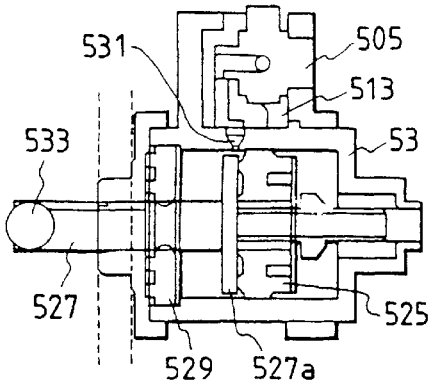
Figure 16:
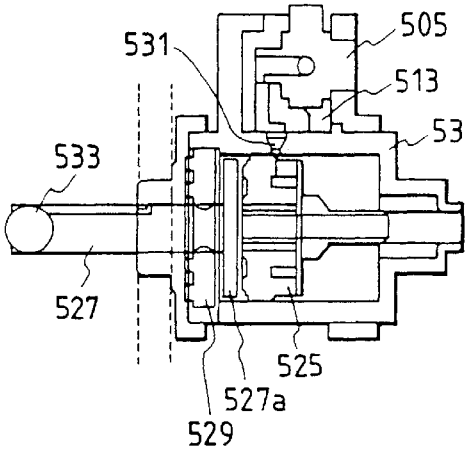
Figure 16:
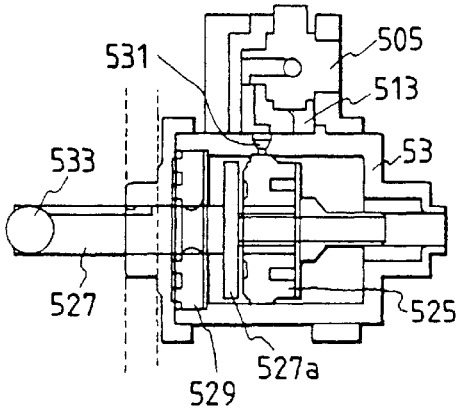
Figure 16:
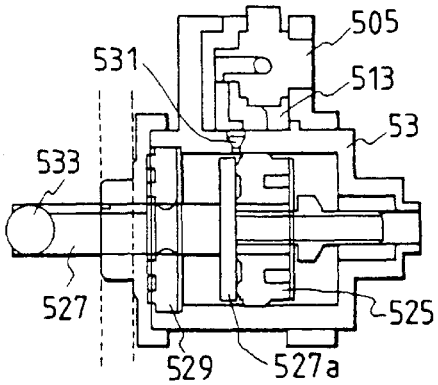

FIG. 14 is an explanatory drawing showing the contour curve of each cam of the cam device, FIG. 15 the major cam positions (operation position of each portion except the pumps corresponding to ⓐ to ⓓ, ⓕ and ⓗ in FIG. 14), and FIG. 16 the operation position of the pump 53 respectively. Numerical values in FIG. 14 are angles of rotation of each cam.

Referring to FIGS. 14 to 16, the function of the recovery system unit according to this embodiment will be described.

In FIG. 14, a state of ⓐ is at the home position of a cam 549, and is a stand-by state of the recovery apparatus during recording. At this time, a switch 555 is ON, the cap 51 is in a state (hereinafter called "open state") of being away from the head discharge port formation surface, and the blade 59 is in the OFF state, that is, this is also in a state of being away from the head discharge port formation surface (See FIG. 15). The pump 53 is at the upper dead center.

ⓑ is in a capping state, and shows when the printer is not used, but the head discharge port formation surface is covered for protection. At this time, the switch 555 is OFF, the cap 51 joins (closed state) the head discharge port formation surface, the pump 53 is at the upper dead center, and further the blade is in the OFF state.

ⓒ is in a state of pumping completed. At this time, the switch 555 is ON, the cap 51 is closed, and the pump 53 is in a state in which the valve has been opened but has not reached the lower dead center. Also the blade 59 is in the OFF state.

ⓓ is in a state in which the cap 51 has been opened after pumping and at the same time, small idle suction has been performed to take ink, with which the cap 51 and cap lever 505 are filled, into the pump 53. At this time, the switch 555 is ON, the cap 51 is almost half opened, the pump 53 is at the lower dead center, and the blade is in the OFF state.

A state of ⓖ will be described earlier. This is a position for preparing to start idle suction in order to exhaust ink, with which the pump 53 is filled, on the waste ink tank side by pumping. At this time, the switch 555 is ON, the cap 51 is opened, and the pump 53 is at a somewhat lower position than the upper dead center. The blade 59 is in the OFF state.

ⓔ and ⓕ are at a stop position when great and medium idle suctions have been performed respectively. At this time in either case, the switch 555 is ON, the cap 51 is opened, and the blade 59 is in the OFF state. However, the state of the pump 53 is at the lower dead center in ⓔ while it has not completely lowered in ⓕ.

ⓗ is in a state of wiping. At this time, the switch 555 is ON, the cap 51 is opened, and the pump is at the upper dead center. The blade 59 is in the ON state, and the head discharge port formation surface can be wiped by moving the carriage 11 with the head cartridge 9 mounted in this state.

In FIG. 16, ① indicates a state in which the piston 525 is at the lower dead center within the pump. Pumping is performed by a negative pressure which is generated by the space on the left side of the piston 525 in the space within the pump 53. A valve port 531 conveys the negative pressure to the cap 51. From the state of ①, it can be seen that the piston 525 has gone beyond the valve port 531 and further advanced to the right side. Since the piston 525 is pressed by the shaft flange 527*a* of the piston from the left side for adhesion here, the generated negative pressure does not leak elsewhere, but is conveyed to the cap 51 side. Ink accumulated in the right side portion of the piston 525 is pushed out into the waste ink tank.

② indicates a state in which the piston 525 is at the upper dead center within the pump. It should be noted that the piston 525 has reached the left side of the valve port 531 and the valve port 531 is not closed. That is, the cap 51 is communicating with air in this state.

③ indicates a state of the pump 53 in the case of ⓒ in FIG. 14. The piston 525 has gone beyond the valve port 531 and advanced somewhat to the right side.

④ indicates a state of the pump 53 in the case of ⓖ in FIG. 14. By reciprocating between this state and a state of ① or ⑤, great and medium suctions are carried out. It should be noted here that the valve port 531 has been closed by the piston 525. Since the pump 53 according to this embodiment has not any object corresponding to a valve which an ordinary pump has, counterflow to the cap 51 side may occur when a positive pressure occurs within the pump.

Leaving the valve port 531 closed except in case of necessity is useful to reduce the counterflow.

⑤ indicates a state in which medium suction has been carried out. It should be noted here that the piston 525 has stopped immediately after it went beyond the valve port 531. If it is assumed that the piston 525 has been moved to the lower dead center ①, the valve port 531 would not be closed for a long time when the piston returns to the upper dead center ② or the position ④ for preparing idle suction. The apparatus is constructed so that some clearance occurs between the piston shaft flange 527*a* and piston 525 to communicate with the space on the right side of the piston 525 so that no positive pressure occurs in the space on the left side at the time. However, a positive pressure occurs owing to resistance of the flow path, etc. and it is likely to cause counter flow. On the other hand, when the piston is allowed to return to ① or ④ from the position of ⑤ as shown in this example, the counter flow is effectively prevented.

Figure 17:
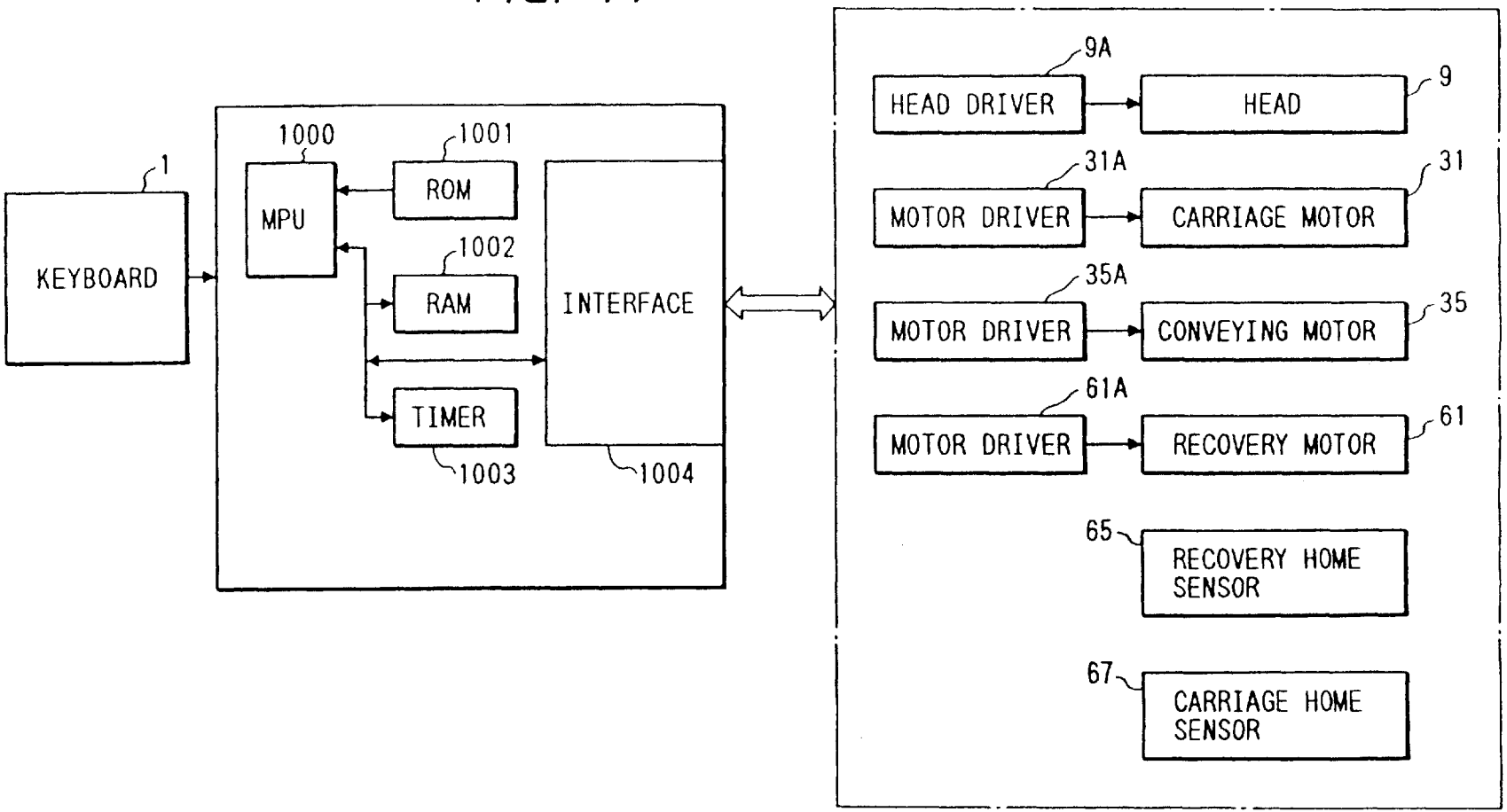
FIG. 17 is a block diagram showing an example of a configuration of the control system of an apparatus according to this example.

FIG. 17 is a block diagram showing the configuration example of the control system of the recording apparatus according to the above configuration.

The cap position and movement position of the carriage 11 can be known by detection of the recovery system home sensor 65 and carriage home sensor 67. In FIG. 17, MPU 1000 controls each portion by performing the control means, etc. to be mentioned later concerning FIG. 18 to FIG. 20.

A ROM 1001 stores a program corresponding to the control procedure, etc., and a RAM 1002 is used as a work area when executing the control procedure. A timer 1003 measures a duration as mentioned later.

Figure 18:
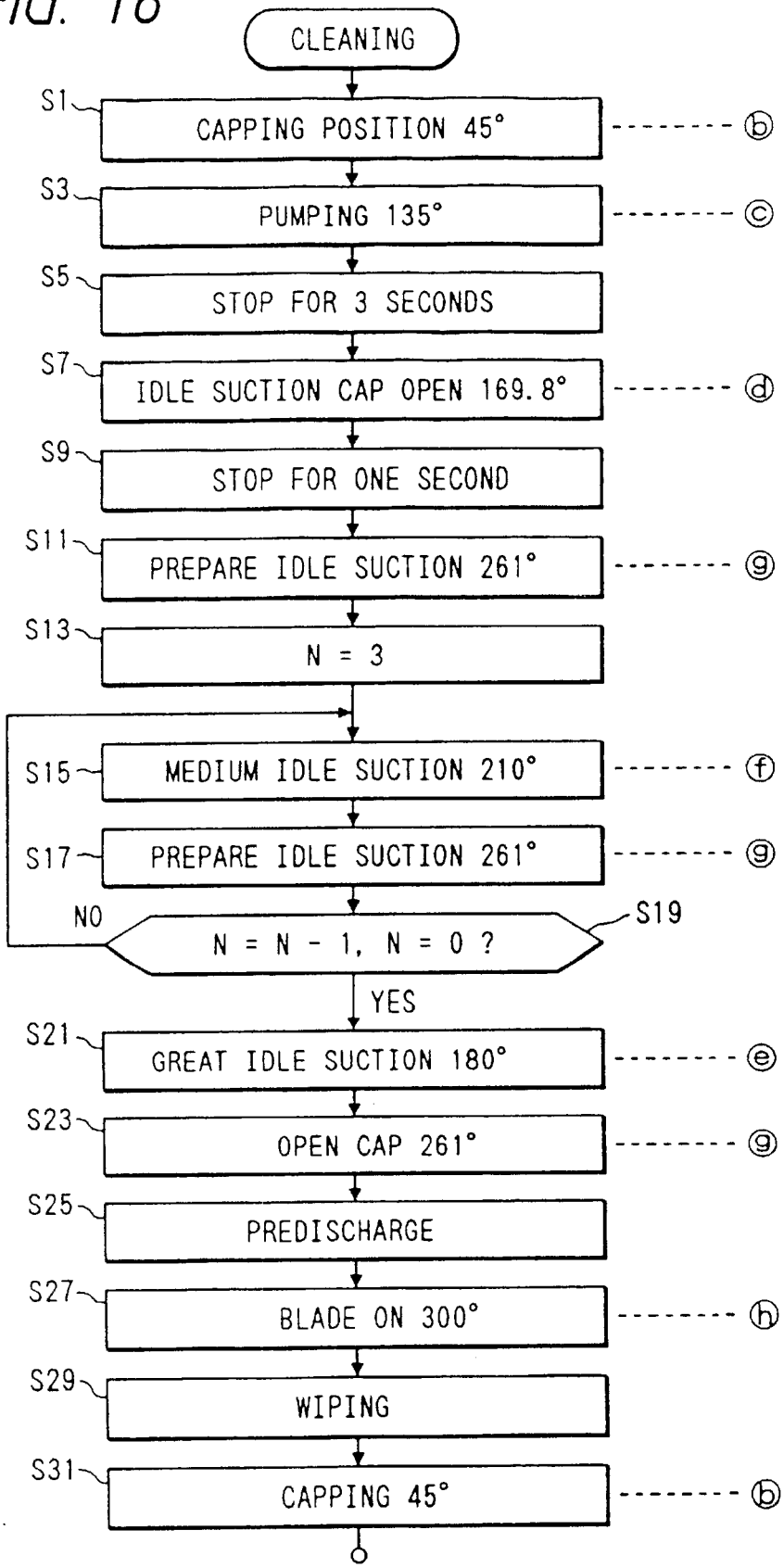
FIG. 18 is a flow chart showing an example of a cleaning procedure in the discharge recovery process.

FIG. 18 shows an example of the head cleaning procedure executed by the recovery system unit under the control of MPV1000 in FIG. 17.

This procedure starts with capping state of ⓗ in FIG. 14 (step S1). The numeral with a degree in each step shows the angle of rotation of a cam in the same way as in FIG. 14. Pumping is carried out (step S3) by moving to a state of ⓒ, and a stop for three seconds (step S5), for example, is allowed to sufficiently suck ink in the state. Small idle suction (step S7) is carried out concurrent with the open cap in ⓓ, and a stop for one second (step S9), for example, is allowed to take ink into the cap 51 and cap lever 505.

Then idle suction is performed to exhaust ink with which the pump 53 is filled. That is, first move to the position for preparing idle suction ⓖ (step S11), and reciprocate between there and medium idle stop position ⓕ three times, for example, (step S13 to S19).

Great idle suction (step S21) is carried out by finally moving the recovery system unit from ⓖ to ⓔ to fully push out ink within the pump 53 into the waste ink tank. The recovery system unit successively moves to ⓖ position (step S23) for predischarging (step S25), and then is set up at ⓗ position to project the blade 59 (step S27). After wiping (step S29), it returns to the initial capping state ⓑ (step S31).

This procedure including the recovery process by suction, idle suction, predischarge, etc. can be arranged to be appropriately performed by a main control routine for the apparatus, or started in accordance with the operator's instruction.

Figure 19:
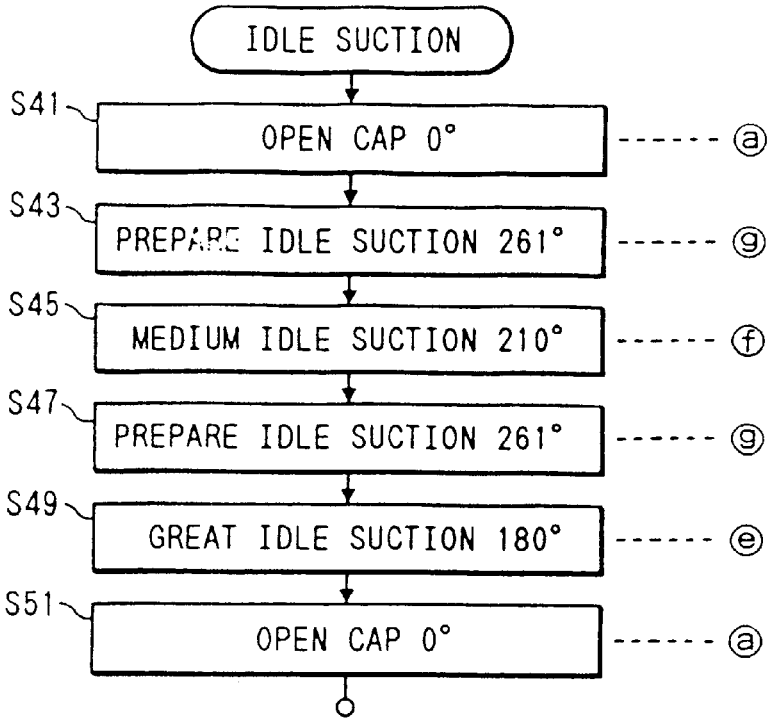
FIG. 19 is a flow chart showing an example of the operation procedure for an idle suction process relating to the discharge recovery process.

FIG. 19 is a flow chart showing an operation example of idle suction to take ink, which is stored by predischarge to be appropriately carried out during recording, into the waste ink tank.

Since this procedure is performed by suspending the recording operation during recording, it starts with the stand-by state of ⓐ in FIG. 14 (step S41 ).

The recovery system unit is moved (step S43) to ⓖ position by reversing the cam 63 in this state, and thereafter is returned to ⓕ position for medium idle suction (step S45). After setting (step S47) to ⓖ position again, it is returned to ⓔ position for great idle suction (step S49). Then it is set to ⓐ state to open the cap (step S51) for recording.

In other words, the present invention is to combine small idle suction, medium idle suction and great idle suction, accumulate ink within the cap absorber near the suction port little by little with a small suction force, and transport the ink at a stroke with a great suction force.

Therefore it is desirable to combine the small suction force and great suction force in this order.

For a combination of these suction forces, a combination may be performed in the order of small idle suction, medium idle suction and great idle suction, and also idle suction may be completed by repeating the small idle suction and medium idle suction a plurality of times and finally performing the great idle suction once or several times.

Also a combination may be performed by repeating the small idle suction or medium idle suction a plurality of times and then performing the great idle suction.

Ink within the cap can be well exhausted by thus changing the suction force, and the amount of ink counter-flow at the initial stage of driving the pump can be reduced in order to satisfactorily accomplish ink exhaust operation.

Figure 20B:
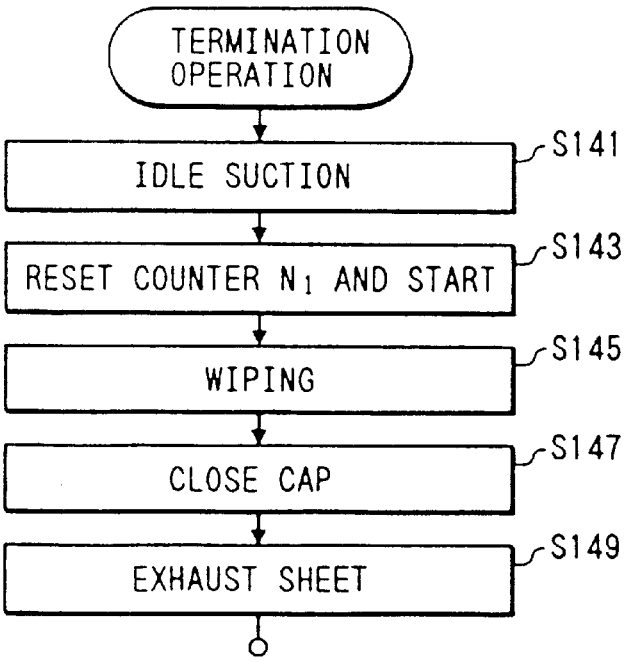
FIGS. 20A and 20B are flow charts showing an example of the recording procedure according to this example.
Figures 1, 20A:
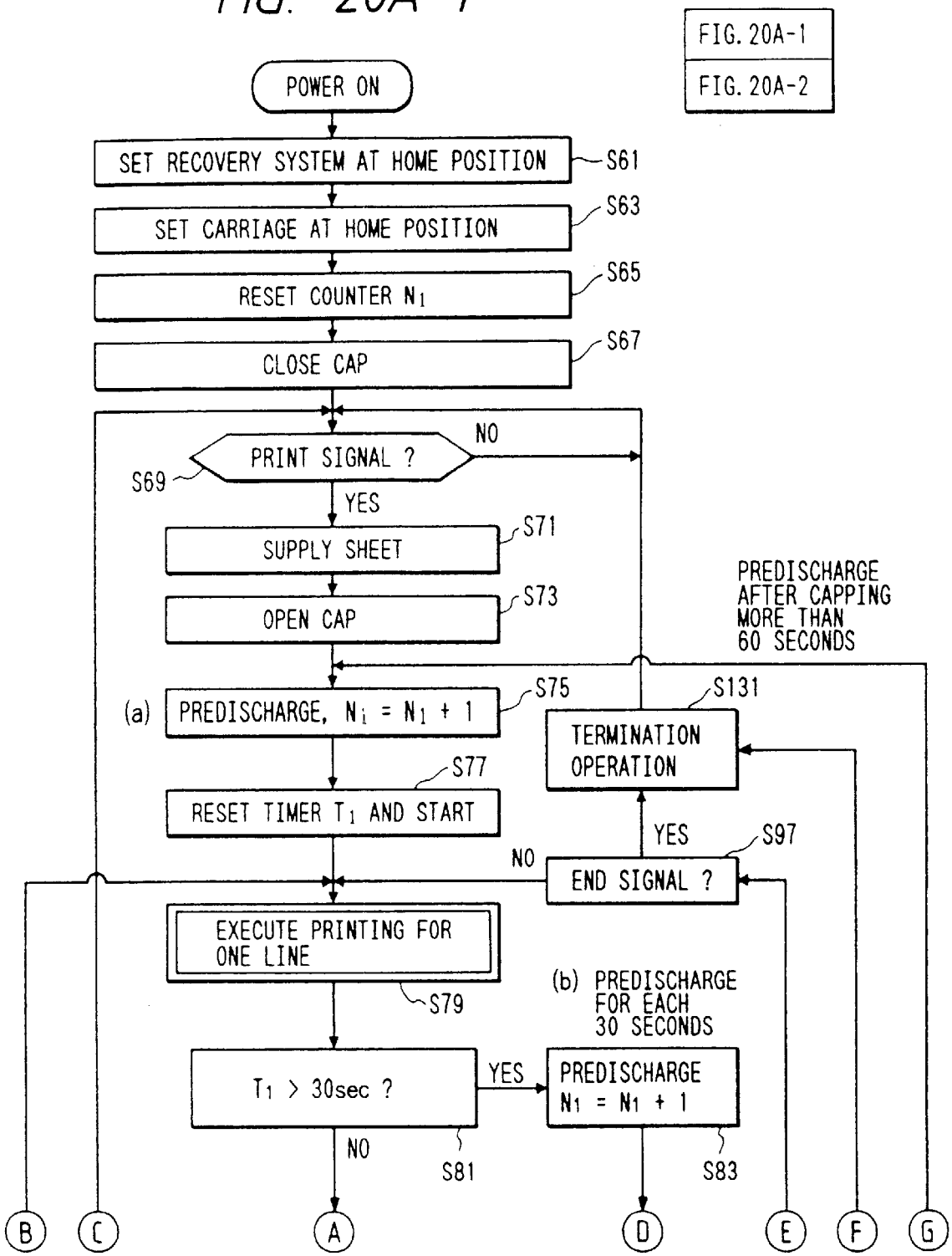

FIGS. 20A and 20B show an example of the recording/printing procedure according to this example.

When the power is turned on in FIG. 20A, set the recovery system unit to the recovery system home position in step S61, and set the carriage to the home position in step S63 after opening the cap. Then in step S65, reset a counter N1 which is used to start an idle suction when a specified number of times for predischarge (15 times or 7 times in this example) is reached. In step S67, stand by (step S69) for a data signal for recording (printing) after closing the cap. This number of times should be, of course, set in accordance with the amount of ink to be exhausted by predischarge, and if a large amount of ink is exhausted, the number of times should be reduced for setting.

When a print signal is input, start supply sheet in step S71, set the carriage 11 to the home position for predischarging in step S75 after opening the cap in step S73, and at the same time, advance a counter N1 by +1. Then reset a timer T1 which starts predischarge at each specified duration (for example, once every 30 seconds) during recording in step S77, and at the same time, start the timer to perform printing for one line in step S79.

Hereafter, judge in step S81 whether or not a value of timer T1 exceeded 30 seconds. If affirmatively judged, proceed to step S87 after having the same steps S83 and S85 as steps S75 and S77 respectively. If negatively judged, proceed to step S87 immediately.

Figures 2, 20A:
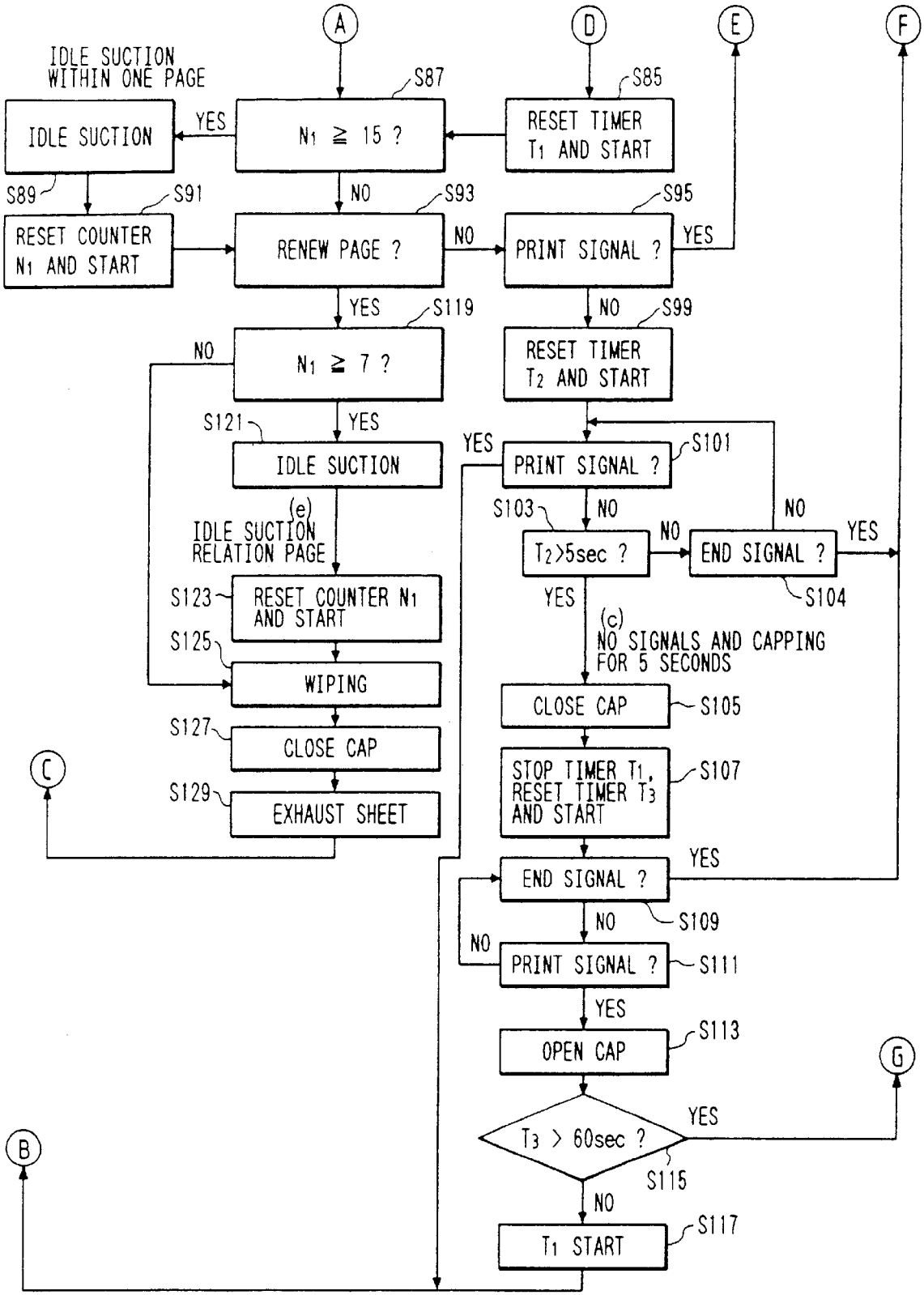

In step S87, judge whether or not the value of counter N1 has reached "15", and if affirmatively judged, perform idle suction midway during printing for one page in step S89. At this time, the procedure shown in FIG. 20 is started.

Thereafter, reset the counter N1 for restarting in step S91, and then proceed to step S93. If negatively judged in step S87, proceed to step S93 immediately.

In step S93, judge whether or not renewing a page has been instructed after completing recording for one page, and if negatively judged, proceed to step S95 to judge the presence of a print signal. If affirmatively judged in step S95, judge in step S97 whether or not there is an END signal of completing the record. If negatively judged, proceed to step S79 for printing the next line.

If no print signal is input in step S95, on the other hand, proceed to step S99, and reset a timer T2, which is used for capping when no print data is input within a specified duration (for example, 5 seconds), for restarting. Then judge the presence of a print signal in step S101, and if affirmatively judged, return to step S79 to execute printing the next line.

If negatively judged, on the other hand, judge in step S103 whether or not the content of counting of the timer T2 has exceeded 5 seconds, and if negatively judged, proceed to step S104. If the END signal is not input, return to step S101.

If 5 seconds have elapsed, on the other hand, close the cap in step S105, stop the timer T1 in step S107, and at the same time, reset a timer T3, which starts predischarge after the capping state has continued for a specified duration (for example, for 60 seconds), for restarting.

Then after judging the presence of input of END signal and print signal (steps S109 and S111), if the input signal is given, open the cap in step S113, and judge in step S115 whether or not the content of counting of the timer T3 has exceeded 60 seconds. If affinnatively judged, proceed to step S75 for predischarging, etc. and then return to step S79. If negatively judged, on the other hand, return to step S79 after starting the timer T1 in step S117.

If a command for renewing the page is input in step S93, proceed to step S119, and judge whether or not the content of counter N1 has exceeded "7". If affirmatively judged, perform intrapage idle suction in step S121, and proceed to step S125 for above-mentioned wiping after resetting/starting the counter N1 in step S123.

If negatively judged, on the other hand, proceed to step S125 immediately for above-mentioned wiping. Then close the cap in step S127, and after exhausting a sheet, on which recording has been performed, in step S129, proceed to step S69 to stand by for a print signal for the next page.

When a END signal has been detected in step S97 or S109, execute an operation for terminating the step S131. This process performs, as shown in FIG. 21B, the idle suction (step S141), reset/start (step S143) of counter N1, wiping (step S145), closing the cap (step S147) and exhaust sheet (step S149).

To summarize the above main operations, predischarge is first cited. In this example, predischarge is performed immediately before printing, and thereafter predischarge is performed at intervals of 30 seconds. For the addition at intervals of 30 seconds, the timer T1 is used. If it enters capping (c) when more than 5 seconds have elapsed without print signal, T1 is stopped. Therefore, the duration for capping is not counted in these intervals of 30 seconds.

When it takes more than 60 seconds to perform capping (c), the control procedure returns to predischarge (a), and predischarge is performed before printing after opening the cap.

In this embodiment, predischarge is performed within the cap. Accordingly, when repeating the predischarge, it is necessary to perform idle suction in order to take in ink, which accumulates within the cap by the repeated predischarge, on the waste ink tank side. This is an idle suction in FIG. 19.

Basically idle suction is performed between pages in which printing is not performed. When a counter N1 for predischarge indicates more than 7 after printing for one page, an idle suction (d) is performed. When Ni exceeds 15 within one page during printing, however, in other words, an idle suction (e) is performed in sentences requiring a long printing time. Also when printing is terminated, an idle suction is always performed.

Wiping is to clean a head face surface wet with ink after printing, and is to be performed after terminating printing for one page and all pages.

According to this example as mentioned above, perform about twice a similar operation to the idle suction after sucking ink, midway during printing or after terminating printing. This operation has the same effect as to effectively feed ink, which accumulates in the cap by predischarge during printing, into the waste ink tank.

The amount of ink, which accumulates in the cap by predischarge, is much less than that when sucking ink during cleaning that is performed to recover discharge. Therefore, idle suction during printing is performed less number of times than the number of times for idle suction during cleaning. Reducing the number of times as far as possible is effective to improve the effective printing speed of the recording apparatus.

The number of times for idle suction during cleaning or during printing is not limited to the above example, but an appropriate number of times can, of course, be set.

Also, according to this example, by taking short strokes at first in reciprocating the piston in idle suction for several times and taking such a long stroke as to reach the lower dead center in the final several times, it is possible to securely take ink within the cap 51 into the pump 53 with less counter flow, and further realize an effective idle suction which reduces the amount of ink remaining in the pump 53 and effectively feeds most of the ink amount into the waste ink tank.

As regards how to change the stroke in an idle suction operation, short strokes (medium idle suction) were taken three times and one long stroke (great idle suction) was taken in the above example. However, the number of times can be, of course, changed appropriately.

The waste ink tank according to this example will be described.

As shown in FIG. 2, in addition to the first waste ink tank 55, a second waste ink tank 70 is provided by effectively utilizing the space within the apparatus, and a tube 71 is used to connect between these waste ink tanks in this example. Since both tanks are provided in series with reference to the recovery system unit, waste ink, which is produced by discharge recovery process or the above-mentioned idle suction process, is first led into the first waste ink tank 55 through a tube 57.

While the first waste ink tank 55 has room for waste ink, the waste ink is stored here. When the first waste ink tank 55 has no more room for it hereafter, the overflowed waste ink will be led to the second waste ink tank 70 through the tube 71.

Since the second waste ink tank 70 is thus provided by effectively utilizing the space within the apparatus in this example, it is possible to miniaturize the apparatus without reducing the capacity for receiving waste ink.

Also it is possible to provide appropriate ink absorbers within these waste ink tanks. In FIG. 2, a breathing fabric 183 is permeable to ink solvent vapor, but is impervious to ink, being liquid, and concretely "Paper load" (made by Teijin Limited), for example, can be used. Placing such a breathing fabric 183 prevents ink leakage from waste ink tanks 55 and 70. Though two waste ink tanks are connected in series in the above example, both can be provided in parallel with reference to the recovery system unit.

Figure 21:
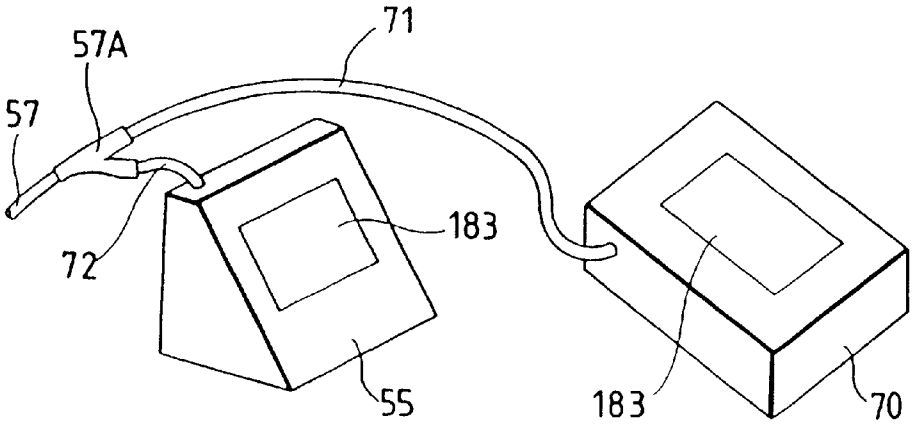
FIGS. 21 and 22 are perspective views showing two different embodiments of the waste ink system.

FIG. 21 shows an example of configuration for the above. In this example, a three-way joint 57A is provided at one end of a tube 57, the other end of which is connected to the recovery system unit, and this three-way joint 57A branches the flow of waste ink so that waste ink is led into waste ink tanks 55 and 70 through tubes 72 and 71 respectively. The similar effect can be obtained in this example.

From a viewpoint of providing waste ink tanks by effectively utilizing the empty space within the apparatus, that can exist dispersed, it is, of course, possible to provide not only the second waste ink tank but also further several waste ink tanks in appropriate empty space.

Figure 22:
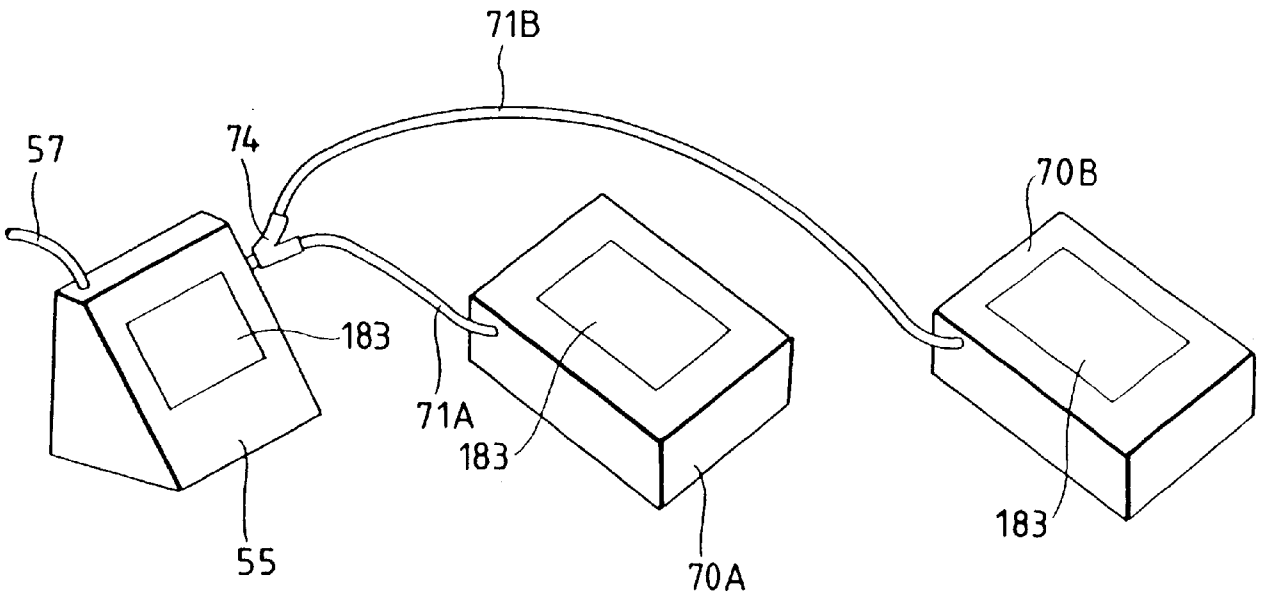
Figure 23:
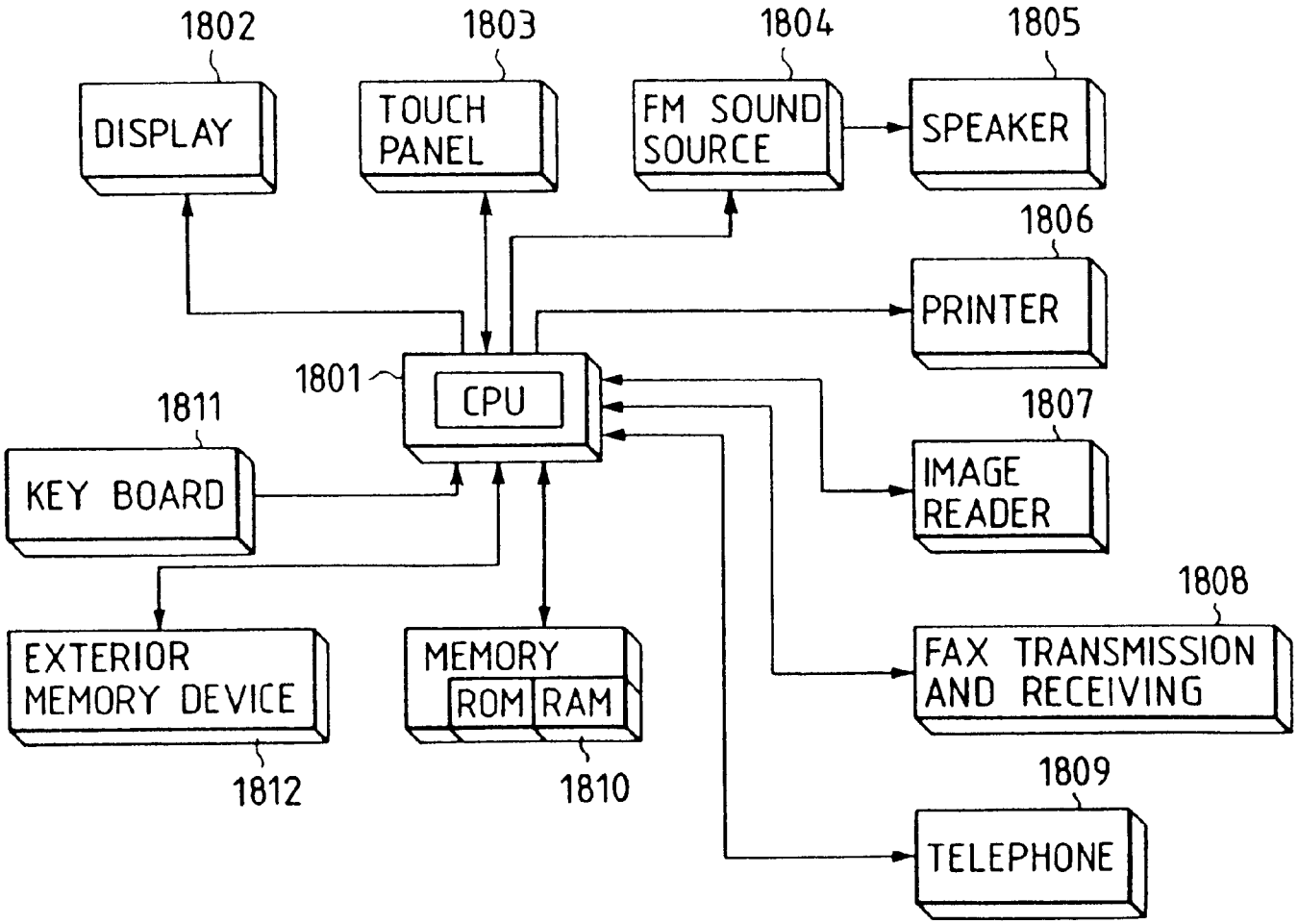
FIG. 23 is a block diagram showing an outline configuration of application of the present invention to an information processing device.
Figure 24:
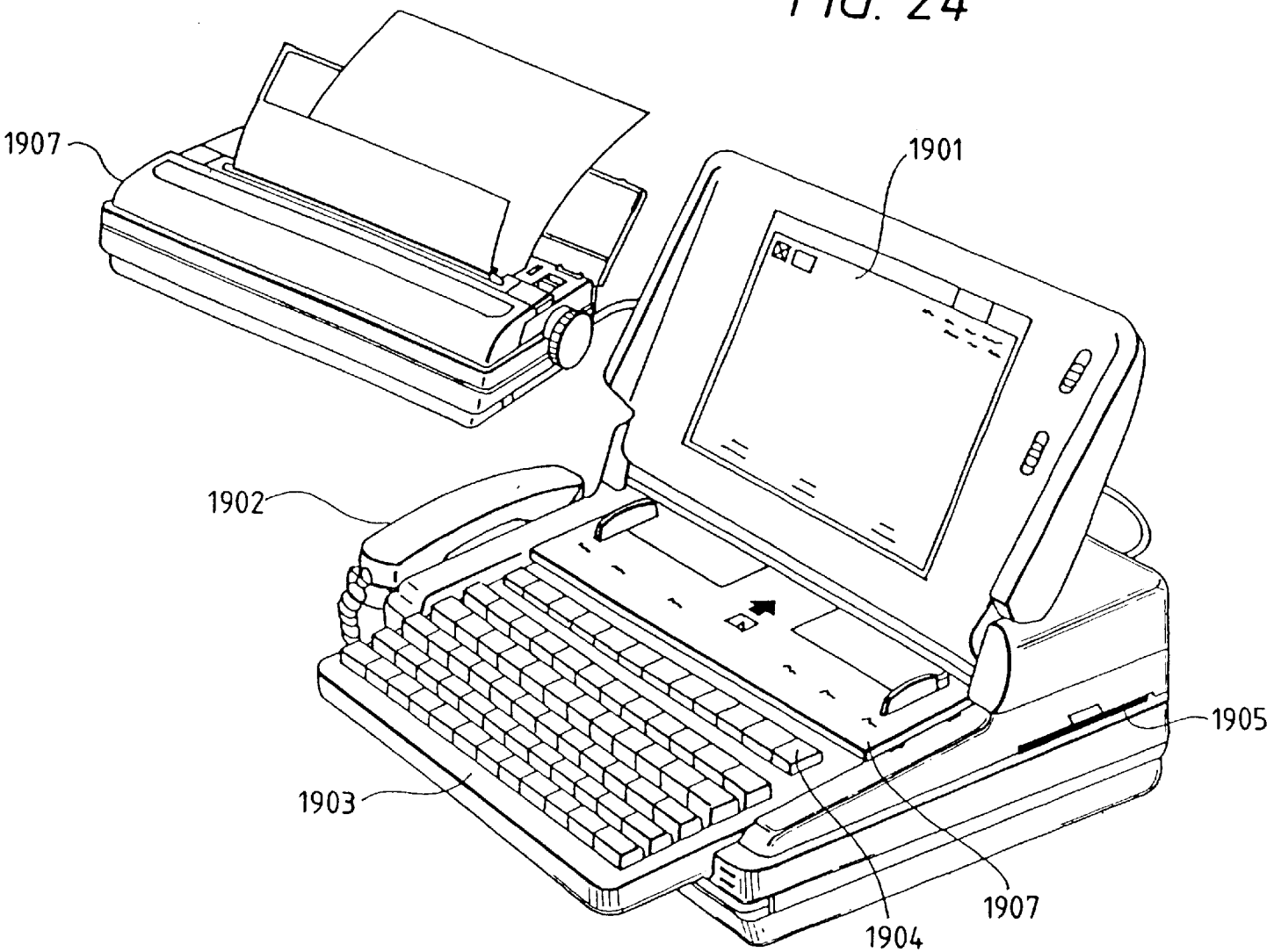
FIG. 24 is a typical outside view of an information processing device shown in FIG. 18.
Figure 25:
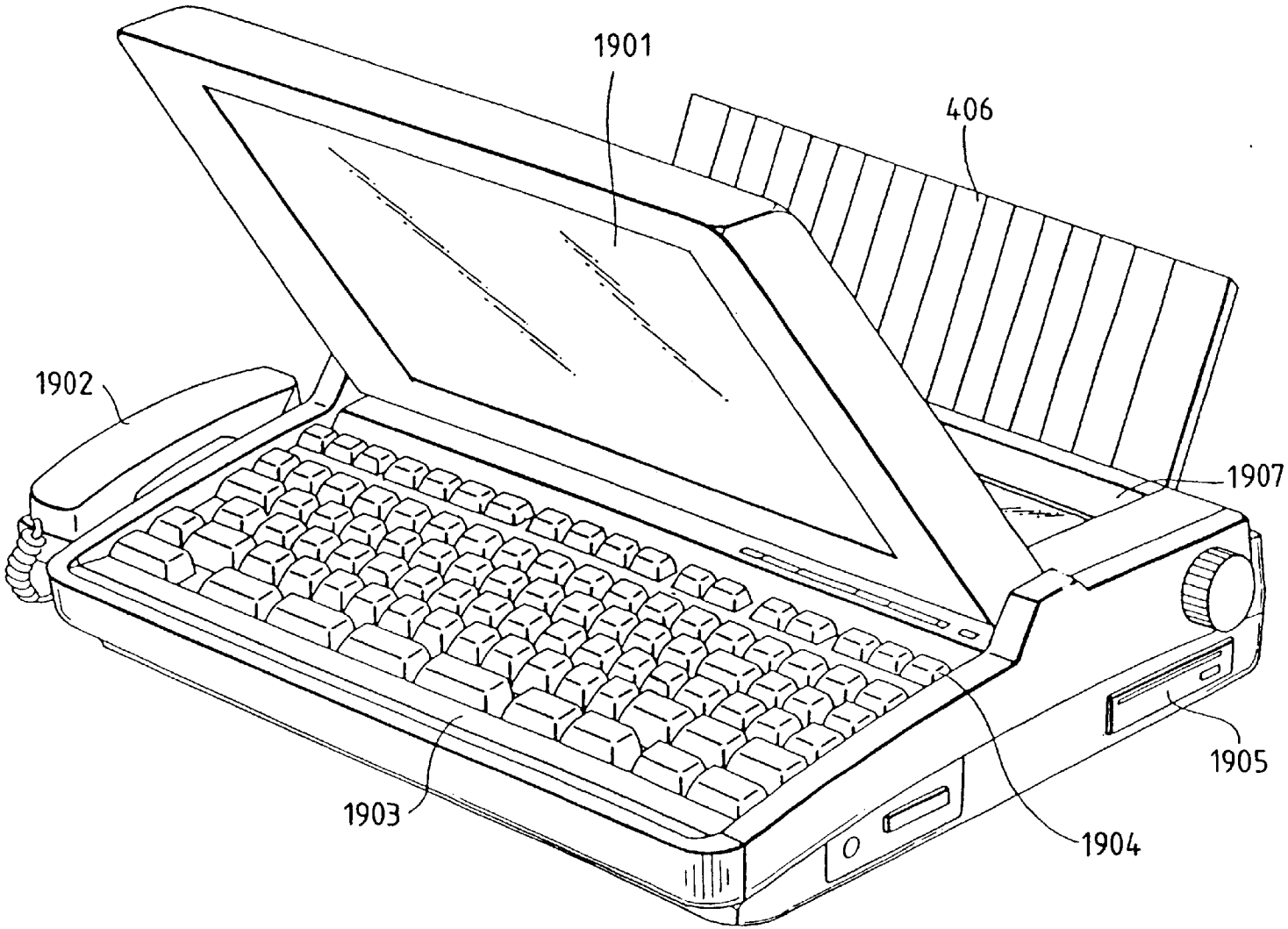
FIG. 25 is a typical outside view of a monolithic information processing device.

FIG. 22 shows an example of the configuration when two waste ink tanks are further provided in addition to the waste ink tank 55, and a second waste ink tank 70A and a third waste ink tank 70B are provided in parallel with reference to the waste ink tank 55. When waste ink overflows the waste ink tank 55, this waste ink is branched by a joint 74, and is led into the second waste ink tank 70A and the third waste ink tank 70B through tubes 71A and 71B respectively.

The waste ink receiving capacity can be further increased by using such a configuration.

As regards connection between these waste ink tanks, or among more waste ink tanks, an appropriate configuration can, of course, be taken.

The present invention brings about excellent effects in recording heads and recording apparatus of the ink jet recording method, that forms flying liquid droplets by utilizing heat energy for recording, especially in ink jet recording methods.

As regards its typical configuration and principle, it is desirable to use the basic principle disclosed in, for example, U.S. Pat. Nos. 4,723,129 and 4,740,796 for operation. This method is applicable to both the so-called on-demand type and continuous type.

Especially in the case of the on-demand type, by applying at least one driving signal, that corresponds to the recording information and provides recording liquid with rapid temperature rise beyond nucleate boiling, to an electro-thermal converter, which is located corresponding to a sheet holding the recording liquid (ink) and the liquid path, generates heat energy in the electro-thermal converter, causing film boiling to the recording liquid near the heat operating surface of the recording head. As a result, it is possible to form air bubbles in the recording liquid by coping with this driving signal one to one.

At least one droplet is formed by allowing the recording liquid to discharge in air through the discharge port by means of an operation force, that occurs in growth and contraction process of this air bubble. Since providing this driving signal with pulse shape causes immediate and proper growth and contraction to air bubble, recording liquid especially excellent in response can be discharged, which is preferable.

For this pulse-shaped driving signal, such signals as specified in U.S. Pat. Nos. 4,463,359 and 4,345,262 are suitable. Also by adopting the conditions specified in U.S. Pat. No. 4,313,124 of an invention on rate of temperature rise on the above-mentioned heat operating surface, a further excellent recording can be performed.

For configuration of the recording head, in addition to a combination configuration (linear liquid flow path or rectangular liquid flow path) of such discharge port, liquid path and electro-thermal converter as disclosed in the above-mentioned each specification, configurations using U.S. Pat. Nos. 4,558,333 and 4,459,600 that disclose a configuration, in which the heat operating unit is located in a bending region, are also included in the present invention.

Further for the full-line type recording head having a length corresponding to the width of a maximum recording medium which the recording apparatus is capable of recording, both a configuration, which meets the length by a combination of such plural recording heads as disclosed in the above-mentioned specifications, and a configuration as a single recording head integrated into one may be used. In either case, the present invention can more effectively exhibit the above-mentioned effect.

In addition, when a replaceable chip type recording head, which an electrical connection with the apparatus body or supply of ink from the apparatus body is provided by mounting to the apparatus body, or a cartridge type recording head, in which the recording head itself is integrally provided with an ink supply tank, is used, the present invention is effective.

It is desirable to add recovery means for a recording head, preparatory auxiliary means, etc., which are provided as a configuration of a recording apparatus according to the present invention, because the effects of the present invention can be more stabilized. To concretely cite these, capping means for a recording head, cleaning means, pressurizing or suction means, electro-thermal converter, or another heating element or preheating means by a combination of these means, or predischarge mode, which predischarges separately from recording.

Further, the present invention is very useful for an apparatus which is equipped with not only a recording mode of main color such as black, but also different colors or at least one of full color by color mixture whether the recording head is integrally constructed or is composed of plural units.

Further in addition, for a morphology of the recording apparatus equipped with a recording mechanism using a liquid jet recording head according to the present invention, morpologies of a copying machine combined with a reader, etc., and a facsimile apparatus having a transmitting and receiving function besides being used as an image output terminal of information processing equipment such as computers may be also taken.

FIG. 18 is a block diagram showing an outline configuration when a recording apparatus of the present invention has been applied to information processing device having functions as a word processor, personal computer, facsimile apparatus, and copying machine.

In FIG. 18, a control unit 1801 controls the entire apparatus, and is equipped with CPU such as microprocessor and various I/O ports to control by outputting control signals, data signals, etc. to each portion, and by inputting control signals and data signals from each portion.

A display 1802 shows various menus, document information and image data read by an image reader 1807 on this display screen. A transparent, pressure sensitive touch panel 1803 is provided on the display 1802, and items, coordinate positions, etc. can be input on the display 1802 by pressing the panel surface with the finger, etc.

A FM (Frequency Modulation) sound source unit 1804 stores music information prepared by a music editor, etc. in a memory 1810 or exterior memory device 1812 as digital data, and reads from the memory, etc. for FM modulation. An electric signal from the FM sound source unit 1804 is converted into audible sound by a speaker 1805. The recording apparatus according to the present invention has been applied to a printer 1806 as the output terminal for the word processor, personal computer, facsimile apparatus and copying machine.

An image reader 1807 photoelectrically reads manuscript data for input, and is provided midway on a conveyance route for manuscripts to read various manuscripts in addition to facsimile and copying manuscripts.

A transmitting and receiving unit 1808 facsimile transmits the manuscript data read by the image reader 1807, and receives a transmitted facsimile signal for decoding, having an interface function with outside. A telephone unit 1809 has various telephone finctions such as ordinary telephone and automatic answering telephone functions.

A memory 1810 has a ROM, which stores system programs, manager programs, and other application programs, character font, dictionaries, etc., application programs loaded from the exterior memory device 1812, document information, video RAM and the like. A keyboard 1811 inputs document information, various commands, etc.

The exterior memory device 1812 uses floppy disks or hard disks, etc. as the memory medium, and stores document information, music or audio information, users' application programs, etc.

FIG. 19 is a typical outside view of an information processing device shown in FIG. 18.

In FIG. 19, a flat panel display 1901 using liquid crystal, etc. displays various menus, graphic information, document information, etc. A touch panel 1803 is provided on this display 1901, and coordinate and a specified item can be input by pressing the touch panel 1803 surface with the finger, etc.

A hand set 1902 is used when the apparatus finctions as a telephone set. A keyboard 1903 is removably connected to the main body through a cord, and is used to input various document information and various data. This keyboard 1903 is also provided with various functional keys 1904. Numeral 1905 is a port for inserting a floppy disk into the exterior memory device 212.

Numeral 1906 is a sheet placing unit on which a manuscript read by the image reader 1807 is placed, and the read manuscript is exhausted from behind the apparatus. Received facsimile, etc. is recorded by an ink jet printer 1907.

For the above display 1802, CRT may be used, but a flat panel of liquid crystal display using a ferroelectric liquid crystal is desirable. This is because the weight can be reduced in addition to miniaturization and thinning.

When the above-mentioned information processing device functions as a personal computer or word processor, various information input from the keyboard 211 are processed by the control unit 1801 in accordance with a specified program, and are output as image in the printer 1806.

When the above-mentioned information processing device functions as a receiver for the facsimile apparatus, facsimile information input from the FAX transmitting and receiving unit 1808 through the communication circuit is received and processed by the control unit 1801 in accordance with a specified program, and is output as a received image in the printer 1806.

When the above-mentioned information processing device functions as a copying machine, a manuscript is read by the image reader 1807, and the read manuscript data is output in the printer 1806 as copied image through the control unit 1801. When it functions as a transmitter for the facsimile apparatus, manuscript data read by the image reader 1807 is transmitted and processed by the control unit 1801 in accordance with a specified program, and then is transmitted to the communication circuit through the FAX transmitting and receiving unit 1808.

The above-mentioned information processing device may be of the integral type with a built-in ink jet printer within the main body as shown in FIG. 20. In this case, the portability can be further improved. In FIG. 20, a portion with the same function as in FIG. 19 is affixed with the corresponding mark.

By applying a recording apparatus according to the present invention to a multifunction type information processing device as described above, a recording image with high quality can be obtained at high speed and with low noise. Therefore it is possible to further improve the function of the above information processing device.

As described above, it is possible according to the present invention to securely lead waste ink within a discharge recovery apparatus into the waste ink tank by effectively performing a secure idle suction.

Also according to the present invention, it is possible to miniaturize a recording apparatus without reducing the waste ink receiving capacity because a plurality of waste ink tanks have been placed by utilizing the empty space within the apparatus.

What is claimed is:

1. An ink jet recovery apparatus for use with an ink jet head for discharging ink, comprising:

a cap for receiving ink which is located opposite to said ink jet head when maintaining and recovering ink discharge from said ink jet head;

a waste ink tank for receiving ink exhausted from said cap;

an ink pump for transporting ink received by said cap to said waste ink tank by performing idle suction, said ink pump performing the idle suction a number of times; and a control unit for controlling said ink pump to vary the number of times of the idle suction of said ink pump, wherein the idle suction includes idle suction for recovery suction and idle suction for idle discharge, the recovery suction being suction of ink when said cap caps said ink jet head and the idle suction being suction of ink when said cap is communicated with atmosphere, and the number of times of the idle suction is less for the idle suction for idle discharge than for the idle suction for recovery suction.

2. An ink jet recovery apparatus according to claim 1, wherein said ink pump comprises a piston type pump.

3. An ink jet recovery apparatus according to claim 1, wherein said ink jet head utilizes heat energy to discharge the ink, and has an electro-thermal converting element for generating said heat energy.

4. An ink jet recovery apparatus according to claim 1, wherein said ink jet recovery apparatus is used in a recording device including an information processing device which accomplishes recording through a specific signal, and said information processing device is a word processor.

5. An ink jet recovery apparatus according to claim 1, wherein said ink jet recovery apparatus is used in a recording device including an information processing device which accomplishes recording through a specific signal, and said information processing device is a facsimile.

6. An ink jet recovery apparatus according to claim 1, wherein said ink jet recovery apparatus is used in a recording device including an information processing device which accomplishes recording through a specific signal, and said informatoin processing device is a copying machine.

7. An ink jet recovery apparatus according to claim 1, wherein said ink jet recovery apparatus is used in a recording device including an information processing device which accomplishes recording through a specific signal, and said information processing device is a terminal for a computer.

8. An ink jet recording apparatus, comprising:

an ink jet head for discharging ink onto a recording medium;

a supporting member for supporting said ink jet head;

a cap for receiving ink which is located opposite to said ink jet head when the ink jet head performs a maintaining and recovering ink discharge from said ink jet head;

a waste ink tank for receiving ink exhausted from said cap;

an ink pump for transporting ink received by said cap to said waste ink tank by performing idle suction, said ink pump performing the idle suction a number of times; and a control unit for controlling said ink pump to vary the number of times of the idle suction, wherein the idle suction includes idle suction for recovery suction and idle suction for idle discharge, the recovery suction being suction of ink when said cap caps said ink jet head and the idle suction being suction of ink when said cap is communicated with atmosphere, and the number of times of the idle suction is less for the idle suction for idle discharge than for the idle suction for recovery suction.

9. An ink jet recording apparatus according to claim 8, wherein said ink pump comprises a piston type pump.

10. An ink jet recording apparatus according to claim 8, wherein said ink jet head utilizes heat energy to discharge the ink, and has an electro-thermal converting element for generating said heat energy.

11. An ink jet recording apparatus according to claim 8, wherein said ink jet recording apparatus includes an information processing device which accomplishes recording through a specific signal, and said information processing device is a word processor.

12. An ink jet recording apparatus according to claim 8, wherein said ink jet recording apparatus includes an information processing device which accomplishes recording through a specific signal, and said information processing device is a facsimile.

13. An ink jet recording apparatus according to claim 8, wherein said ink jet recording apparatus includes an information processing device which accomplishes recording through a specific signal, and said information processing device is a copying machine.

14. An ink jet recording apparatus according to claim 8, wherein said ink jet recording apparatus includes an information processing device which accomplishes recording through a specific signal, and said information processing device is a terminal for a computer.

15. An ink jet recovery apparatus for use with an ink jet head for discharging ink, comprising:

a cap for receiving ink which is located opposite to said ink jet head when the ink jet head performs a maintaining and recovering ink discharge from said ink jet head;

a waste ink tank for receiving ink exhausted from said cap;

an ink pump for transporting ink received by said cap to said waste ink tank by performing idle suction, said ink pump performing the idle suction a number of times; and a control unit for controlling said ink pump to vary the number of times of the idle suction, wherein the idle suction includes idle suction for recovery suction and idle suction for idle discharge, the recovery suction being suction of ink when said cap caps said ink jet head and the idle suction being suction of ink when said cap is communicated with atmosphere, and the number of times of the idle suction is less for the idle suction for idle discharge than for the idle suction for recovery suction.

16. An ink jet recovery apparatus according to claim 15, wherein said ink pump comprises a piston type pump.

17. An ink jet recovery apparatus according to claim 15, wherein said ink jet head utilizes heat energy to discharge the ink, and has an electro-thermal converting element for generating said heat energy.

18. An ink jet recovery apparatus according to claim 15, wherein said ink jet recovery apparatus is used in a recording device including an information processing device which accomplishes recording through a specific signal, and said information processing device is a word processor.

19. An ink jet recovery apparatus according to claim 15, wherein said ink jet recovery apparatus is used in a recording device including an information processing device which accomplishes recording through a specific signal, and said information processing device is a facsimile.

20. An ink jet recovery apparatus according to claim 15, wherein said ink jet recovery apparatus is used in a recording device including an information processing device which accomplishes recording through a specific signal, and said information processing device is a copying machine.

21. An ink jet recovery apparatus according to claim 15, wherein said ink jet recovery apparatus is used in a recording device including an information processing device which accomplishes recording through a specific signal, and said information processing device is a terminal for a computer.

22. An operating method for an ink jet recovery apparatus, the ink jet recovery apparatus being used with an ink jet head for discharging ink, the method comprising the steps of:

performing a maintaining and recovering ink discharge from said ink jet head;

receiving ink in a cap located opposite to said ink jet head when the ink jet head performs the maintaining and recovering ink discharge;

receiving ink exhausted from said cap in a waste ink tank;

performing idle suction using an ink pump to transport ink received by said cap to said waste ink tank, said idle suction being performed a number of times; and controlling said ink pump to vary the number of times of the idle suction, wherein the idle suction includes idle suction for recovery suction and idle suction for idle discharge, the recovery suction being suction of ink when said cap caps said ink jet head and the idle suction being suction of ink when said cap is communicated with atmosphere, and the number of times of the idle suction is less for the idle suction for idle discharge than for the idle suction for recovery suction.

23. An operating method according to claim 22, wherein said ink pump comprises a piston type pump.

24. An operating method according to claim 22, wherein said ink jet head utilizes heat energy to discharge the ink, and has an electro-thermal converting element for generating said heat energy.

25. An operating method according to claim 22, said ink jet recovery apparatus is used in a recording device including an information processing device which accomplishes recording through a specific signal, and said information processing device is a word processor.

26. An operating method according to claim 22, wherein said ink jet recovery apparatus is used in a recording device including an information processing device which accomplishes recording through a specific signal, and said information processing device is a facsimile.

27. An operating method according to claim 22, wherein said ink jet recovery apparatus is used in a recording device including an information processing device which accomplishes recording through a specific signal, and said information processing device is a copying machine.

28. An operating method according to claim 22, wherein said ink jet recovery apparatus is used in a recording device including an information processing device which accomplishes recording through a specific signal, and said information processing device is a terminal for a computer.

29. An operating method for an ink jet recording apparatus, comprising the steps of:

discharging ink onto a recording medium using an ink jet head;

providing a supporting member for supporting said ink jet head;

performing a maintaining and recovering ink discharge from said ink jet head;

receiving ink in a cap located opposite to said ink jet head when the ink jet head performs the maintaining and recovering ink discharge;

receiving ink exhausted from said cap in a waste ink tank;

performing idle suction using an ink pump to transport ink received by said cap to said waste ink tank, said idle suction being performed a number of times; and controlling said ink pump to vary the number of times of the idle suction, wherein the idle suction includes idle suction for recovery suction and idle suction for idle discharge, the recovery suction being suction of ink when said cap caps said ink jet head and the idle suction being suction of ink when said cap is communicated with atmosphere, and the number of times of the idle suction is less for the idle suction for idle discharge than for the idle suction for recovery suction.

30. An operating method according to claim 29, wherein said ink pump comprises a piston type pump.

31. An operating method according to claim 29, wherein said ink jet head utilizes heat energy to discharge the ink, and has an electro-thernal converting element for generating said heat energy.

32. An operating method according to claim 29, wherein said ink jet recording apparatus includes an information processing device which accomplishes recording through a specific signal, and said information processing device is a word processor.

33. An operating method according to claim 29, wherein said ink jet recording apparatus includes an information processing device which accomplishes recording through a specific signal, and said information processing device is a facsimile.

34. An operating method according to claim 29, wherein said ink jet recording apparatus includes an information processing device which accomplishes recording through a specific signal, and said information processing device is a copying machine.

35. An operating method according to claim 29, wherein said ink jet recording apparatus includes an information processing device which accomplishes recording through a specific signal, and said information processing device is a terminal for a computer.

36. An operating method for an ink jet recovery apparatus for use with an ink jet head for discharging ink, the method comprising the steps of:

performing a maintaining and recovering ink discharge from said ink jet head;

receiving ink in a cap located opposite to said ink jet head when the ink jet head performs a maintaining and recovering ink discharge;

receiving ink exhausted from said cap in a waste ink tank;

performing idle suction using an ink pump to transport ink received by said cap to said waste ink tank, said idle suction being performed a number of times; and controlling said ink pump to vary the number of times of the idle suction, wherein the idle suction includes idle suction for recovery suction and idle suction for idle discharge, the recovery suction being suction of ink when said cap caps said ink jet head and the idle suction being suction of ink when said cap is communicated with atmosphere, and the number of times of the idle suction is less for the idle suction for idle discharge than for the idle suction for recovery suction.

37. An operating method according to claim 36, wherein said ink pump comprises a piston type pump.

38. An operating method according to claim 36, wherein said ink jet head utilizes heat energy to discharge the ink, and has an electro-thermal converting element for generating said heat energy.

39. An operating method according to claim 36, wherein said ink jet recovery apparatus is used in a recording device including an information processing device which accomplishes recording through a specific signal, and said information processing device is a word processor.

40. An operating method according to claim 36, wherein said ink jet recovery apparatus is used in a recording device including an information processing device which accomplishes recording through a specific signal, and said information processing device is a facsimile.

41. An operating method according to claim 36, wherein said ink jet recovery apparatus is used in a recording device including an information processing device which accomplishes recording through a specific signal, and said information processing device is a copying machine.

42. An operating method according to claim 36, wherein said ink jet recovery apparatus is used in a recording device including an information processing device which accomplishes recording through a specific signal, and said information processing device is a terminal for a computer.

43. An ink jet recovery apparatus for use with an ink jet head for discharging ink, comprising:

a cap for receiving ink which is located opposite to said ink jet head when maintaining and recovering ink discharge from said ink jet head;

a waste ink tank for receiving ink exhausted from said cap;

an ink pump for transporting ink received by said cap to said waste ink tank by performing idle suction, said ink pump performing the idle suction a number of times; and a control unit for controlling said ink pump to vary the number of times of the idle suction of said ink pump, wherein the idle suction includes idle suction for recovery suction and idle suction during recording, the recovery suction being suction of ink when said cap caps said ink jet head and the idle suction being suction of ink when said cap is communicated with atmosphere, and the number of times of the idle suction is less for the idle suction during recording than for the idle suction for recovery suction.

44. An ink jet recovery apparatus according to claim 43, wherein said ink pump comprises a piston type pump.

45. An ink jet recovery apparatus according to claim 43, wherein said ink jet head utilizes heat energy to discharge the ink, and has an electro-thermal converting element for generating said heat energy.

46. An ink jet recovery apparatus according to claim 43, wherein said ink jet recovery apparatus is used in a recording device including an information processing device which accomplishes recording through a specific signal, and said information processing device is a word processor.

47. An ink jet recovery apparatus according to claim 43, wherein said ink jet recovery apparatus is used in a recording device including an information processing device which accomplishes recording through a specific signal, and said information processing device is a facsimile.

48. An ink jet recovery apparatus according to claim 43, wherein said ink jet recovery apparatus is used in a recording device including an information processing device which accomplishes recording through a specific signal, and said information processing device is a copy machine.

49. An ink jet recovery apparatus according to claim 43, wherein said ink jet recovery apparatus is used in a recording device including an information processing device which accomplishes recording through a specific signal, and said information processing device is a terminal for a computer.

50. An ink jet recording apparatus, comprising:

an ink jet head for discharging ink onto a recording medium;

a supporting member for supporting said ink jet head;

a cap for receiving ink which is located opposite to said ink jet head when the ink jet head performs a maintaining and recovering ink discharge from said ink jet head;

a waste ink tank for receiving ink exhausted from said cap;

an ink pump for transporting ink received by said cap to said waste ink tank by performing idle suction, said ink pump performing the idle suction a number of times; and a control unit for controlling said ink pump to vary the number of times of the idle suction, wherein the idle suction includes idle suction for recovery suction and idle suction during recording, the recovery suction being suction of ink when said cap caps said ink jet head and the idle suction being suction of ink when said cap is communicated with atmosphere, and the number of times of the idle suction is less for the idle suction during recording than for the idle suction for recovery suction.

51. An ink jet recording apparatus according to claim 50, wherein said ink pump comprises a piston type pump.

52. An ink jet recording apparatus according to claim 50, wherein said ink jet head utilizes heat energy to discharge the ink, and has an electro-thermal converting element for generating said heat energy.

53. An ink jet recording apparatus according to claim 50, wherein said ink jet recording apparatus includes an information processing device which accomplishes recording through a specific signal, and said information processing device is a word processor.

54. An ink jet recording apparatus according to claim 50, wherein said ink jet recording apparatus includes an information processing device which accomplishes recording through a specific signal, and said information processing device is a facsimile.

55. An ink jet recording apparatus according to claim 50, wherein said ink jet recording apparatus includes an information processing device which accomplishes recording through a specific signal, and said information processing device is a copy machine.

56. An ink jet recording apparatus according to claim 50, wherein said ink jet recording apparatus includes an information processing device which accomplishes recording through a specific signal, and said information processing device is a terminal for a computer.

57. An ink jet recovery apparatus for use with an ink jet head for discharging ink, comprising:

a cap for receiving ink which is located opposite to said ink jet head when the ink jet head performs a maintaining and recovering ink discharge from said ink jet head;

a waste ink tank for receiving ink exhausted from said cap;

an ink pump for transporting ink received by said cap to said waste ink tank by performing idle suction, said ink pump performing the idle suction a number of times; and a control unit for controlling said ink pump to vary the number of times of the idle suction, wherein the idle suction includes idle suction for recovery suction and idle suction during recording, the recovery suction being suction of ink when said cap caps said ink jet head and the idle suction being suction of ink when said cap is communicated with atmosphere, and the number of times of the idle suction is less for the idle suction during recording than for the idle suction for recovery suction.

58. An ink jet recovery apparatus according to claim 57, wherein said ink pump comprises a piston type pump.

59. An ink jet recovery apparatus according to claim 57, wherein said ink jet head utilizes heat energy to discharge the ink, and has an electro-thermal converting element for generating said heat energy.

60. An ink jet recovery apparatus according to claim 57, wherein said ink jet recovery apparatus is used in a recording device including an information processing device which accomplishes recording through a specific signal, and said information processing device is a word processor.

61. An ink jet recovery apparatus according to claim 57, wherein said ink jet recovery apparatus is used in a recording device including an information processing device which accomplishes recording through a specific signal, and said information processing device is a facsimile.

62. An ink jet recovery apparatus according to claim 57, wherein said ink jet recovery apparatus is used in a recording device including an information processing device which accomplishes recording through a specific signal, and said information processing device is a copying machine.

63. An ink jet recovery apparatus according to claim 57, wherein said ink jet recovery apparatus is used in a recording device including an information processing device which accomplishes recording through a specific signal, and said information processing device is a terminal for a computer.

64. An operating method for an ink jet recovery apparatus, the ink jet recovery apparatus being used with an ink jet head for discharging ink, the method comprising the steps of:

performing a maintaining and recovering ink discharge from said ink jet head;

receiving ink in a cap located opposite to said ink jet head when the ink jet head performs the maintaining and recovering ink discharge;

receiving ink exhausted from said cap in a waste ink tank;

performing idle suction using an ink pump to transport ink received by said cap to said waste ink tank, said idle suction being performed a number of times; and controlling said ink pump to vary the number of times of the idle suction, wherein the idle suction includes idle suction for recovery suction and idle suction during recording, the recovery suction being suction of ink when said cap caps said ink jet head and the idle suction being suction of ink when said cap is communicated with atmosphere, and the number of times of the idle suction is less for the idle suction during recording than for the idle suction for recovery suction.

65. An operating method according to claim 64, wherein said ink pump comprises a piston type pump.

66. An operating method according to claim 64, wherein said ink jet head utilizes heat energy to discharge the ink, and has an electro-thermal converting element for generating said heat energy.

67. An operating method according to claim 64, wherein said ink jet recovery apparatus is used in a recording device including an information processing device which accomplishes recording through a specific signal, and said information processing device is a word processor.

68. An operating method according to claim 64, wherein said ink jet recovery apparatus is used in a recording device including an information processing device which accomplishes recording through a specific signal, and said information processing device is a facsimile.

69. An operating method according to claim 64, wherein said ink jet recovery apparatus is used in a recording device including an information processing device which accomplishes recording through a specific signal, and said information processing device is a copying machine.

70. An operating method according to claim 64, wherein said ink jet recovery apparatus is used in a recording device including an information processing device which accomplishes recording through a specific signal, and said information processing device is a terminal for a computer.

71. An operating method for an ink jet recording apparatus, comprising the steps of:

discharging ink onto a recording medium using an ink jet head;

providing a supporting member for supporting said ink jet head;

performing a maintaining and recovering ink discharge from said ink jet head;

receiving ink in a cap located opposite to said ink jet head when the ink jet head performs the maintaining and recovering ink discharge;

receiving ink exhausted from said cap in a waste ink tank;

performing idle suction using an ink pump to transport ink received by said cap to said waste ink tank, said idle suction being performed a number of times; and controlling said ink pump to vary the number of times of the idle suction, wherein the idle suction includes idle suction for recovery suction and idle suction during recording, the recovery suction being suction of ink when said cap caps said ink jet head and the idle suction being suction of ink when said cap is communicated with atmosphere, and the number of times of the idle suction is less for the idle suction during recording than for the idle suction for recovery suction.

72. An operating method according to claim 71, wherein said ink pump comprises a piston type pump.

73. An operating method according to claim 71, wherein said ink jet head utilizes heat energy to discharge the ink, and has an electro-thermal converting element for generating said heat energy.

74. An operating method according to claim 71, wherein said ink jet recording apparatus includes an information processing device which accomplishes recording through a specific signal, and said information processing device is a word processor.

75. An operating method according to claim 71, wherein said ink jet recording apparatus includes an information processing device which accomplishes recording through a specific signal, and said information processing device is a facsimile.

76. An operating method according to claim 71, wherein said ink jet recording apparatus includes an information processing device which accomplishes recording through a specific signal, and said information processing device is a copying machine.

77. An operating method according to claim 71, wherein said ink jet recording apparatus includes an information processing device which accomplishes recording through a specific signal, and said information processing device is a terminal for a computer.

78. An operating method for an ink jet recovery apparatus for use with an ink jet head for discharging ink, the method comprising the steps of:

performing a maintaining and recovering ink discharge from said ink jet head;

receiving ink in a cap located opposite to said ink jet head when the ink jet head performs a maintaining and recovering ink discharge;

receiving ink exhausted from said cap in a waste ink tank;

performing idle suction using an ink pump to transport ink received by said cap to said waste ink tank, said idle suction being performed a number of times; and controlling said ink pump to vary the number of times of the idle suction, wherein the idle suction includes idle suction for recovery suction and idle suction during recording, the recovery suction being suction of ink when said cap caps said ink jet head and the idle suction of ink being suction of ink when said cap is communicated with atmosphere, and the number of times of the idle suction is less for the idle suction during recording than for the idle suction for recovery suction.

79. An operating method according to claim 78, wherein said ink pump comprises a piston type pump.

80. An operating method according to claim 78, wherein said ink jet head utilizes heat energy to discharge the ink, and has an electro-thermal converting element for generating said heat energy.

81. An operating method according to claim 78, wherein said ink jet recovery apparatus is used in a recording device including an information processing device which accomplishes recording through a specific signal, and said information processing device is a word processor.

82. An operating method according to claim 78, wherein said ink jet recovery apparatus is used in a recording device including an information processing device which accomplishes recording through a specific signal, and said information processing device is a facsimile.

83. An operating method according to claim 78, wherein said ink jet recovery apparatus is used in a recording device including an information processing device which accomplishes recording through a specific signal, and said information processing device is a copying machine.

84. An operating method according to claim 78, wherein said ink jet recovery apparatus is used in a recording device including an information processing device which accomplishes recording through a specific signal, and said information processing device is a terminal for a computer.

* * * * *